US009308751B2

(12) United States Patent
Writt et al.

(10) Patent No.: US 9,308,751 B2
(45) Date of Patent: Apr. 12, 2016

(54) SENSOR FOR DETERMINING INK DRYING TIME IN A PAGE-WIDE INKJET PRINTER

(71) Applicant: FUNAI ELECTRIC CO., LTD., Daito-shi, Osaka (JP)

(72) Inventors: John Thomas Writt, Lexington, KY (US); Jose Paul Sacoto Aguilar, Lexington, KY (US)

(73) Assignee: FUNAI ELECTRIC CO., LTD (JP)

( * ) Notice: Subject to any disclaimer, the term of this patent is extended or adjusted under 35 U.S.C. 154(b) by 0 days.

(21) Appl. No.: 14/817,046

(22) Filed: Aug. 3, 2015

(65) Prior Publication Data

US 2015/0336405 A1 Nov. 26, 2015

Related U.S. Application Data

(63) Continuation of application No. 13/731,352, filed on Dec. 31, 2012, now Pat. No. 9,096,080.

(51) Int. Cl.

| | |
|---|---|
| ***B41J 29/393*** | (2006.01) |
| ***B41J 11/00*** | (2006.01) |
| ***B41J 2/01*** | (2006.01) |

(52) U.S. Cl.
CPC ..... *B41J 11/0015* (2013.01); *B41J 2/01* (2013.01)

(58) Field of Classification Search
CPC ..... B41J 29/393; B41J 29/38; B41J 29/02
See application file for complete search history.

(56) References Cited

U.S. PATENT DOCUMENTS

| | | | | |
|---|---|---|---|---|
| 6,457,801 | B1 | 10/2002 | Fish et al. | |
| 7,104,627 | B2 | 9/2006 | Weast | |
| 8,770,706 | B1 | 7/2014 | Writt et al. | |
| 9,096,080 | B2 * | 8/2015 | Writt | B41J 13/0027 |

* cited by examiner

*Primary Examiner* — Lamson Nguyen
(74) *Attorney, Agent, or Firm* — Amster, Rothstein & Ebenstein LLP

(57) ABSTRACT

A page-wide inkjet printer for determining a drying time of a print swath of ink deposited on a sheet of media by a fixed printhead spanning a width of a printing zone in a subscan direction. The printer has a controller communicatively coupled to each of the printhead and a moveable gloss sensor or a scan bar for processing a respective output response for the determining the drying time of the print swath.

10 Claims, 13 Drawing Sheets

SENSOR FOR DETERMINING INK DRYING TIME IN A PAGE-WIDE INKJET PRINTER

CROSS REFERENCES TO RELATED APPLICATIONS

This patent application is related to U.S. patent application Ser. No. 13/731,185, filed on Dec. 31, 2012 (now issued as U.S. Pat. No. 8,770,706), entitled "SCAN AND PAUSE METHOD FOR DETERMINING INK DRYING TIME IN AN INKJET PRINTER"; U.S. patent application Ser. No. 13/731,199, filed on Dec. 31, 2012 (now issued as U.S. Pat. No. 8,801,139), entitled "SEQUENTIAL SCAN METHOD DOR DETERMINING INK DRYING TIME IN AN INKJET PRINTER"; and U.S. patent application Ser. No. 13/731,293, filed on Dec. 31, 2012 (now issued as U.S. Pat. No. 8,845,061), entitled "INKJET PRINTER WITH DUAL FUNCTION ALIGNMENT SENSOR FOR DETERMINING INK DRYING TIME". Each of the foregoing applications is assigned to the assignee of the present application.

STATEMENT REGARDING FEDERALLY SPONSORED RESEARCH OR DEVELOPMENT

None.

REFERENCE TO SEQUENTIAL LISTING, ETC

None.

BACKGROUND

1. Field of the Invention

The present invention relates generally to an inkjet printer, and more particularly to methods for determining the drying time of ink ejected onto a sheet of media and to inkjet printers using the same.

2. Description of the Related Art

In prior art, an inkjet printer forms an image on a sheet of media, such as paper, by positioning a printhead in close proximity with the recording medium, and selectively ejecting ink from a plurality of inkjet ting nozzles of the printhead to form a pattern of ink dots on the recording medium. During inkjet printing, the printhead is spaced apart from the recording medium in a plane perpendicular to the sheet of media. As the printhead is moved across the sheet of media, from one end to another in a scan direction, ink is selectively ejected from the inkjet ting nozzles to form a print swath. After completing at least one print swath, the sheet of media is indexed a selected amount in a sub scan, i.e., paper feed, direction.

A common problem is determining when the ink deposited on the media is dry so that smearing does not occur when the printed media is further processed in the imaging apparatus. The printout in FIG. 1 is a test page that was printed on an inkjet printer using default setting and duplexing using a common plain media, M. The printout contains regular and bolded text, a solid black block and a line of diamonds adjacent the left and right edges of the media M. The streaks S above the black rectangle are due to the ink not being fully dry (absorbed) when the paper underwent a duplex operation. In addition to these obvious streaks S, there is ink transfer T from the bold text as well which can be seen in the expanded portion of FIG. 1 shown in FIG. 2. A user would find this print output objectionable.

One cause for the smearing and transfer shown in FIGS. 1-2, is that some media absorb ink faster than others and the media M was moved prior to the ink being dry. In setting the default dry time, developers have to pick a value that seems to be the best balance between dry time and throughput. However, any users experiencing such smearing will view this dry time setting as unacceptable. Further, in our testing, plain media with the COLORLOK additive seem to have the most smearing. It is thought that the flocculation of pigment particles near the paper surface and the resulting "filter cake" impedes ink absorption by the media. Although there is a COLORLOK media setting in the printer driver software that doubles the dry time from about 10 sec to about 20 sec, many users will not appropriately change the setting resulting in smeared printed media. What is needed is a way for the inkjet printer to automatically determine when ink is sufficiently dried/absorbed so that further operations, such as a duplex operation, can be accomplished without smearing in the shortest amount of time.

SUMMARY OF THE INVENTION

An ink jet printer for printing an image on a sheet of media comprises a printhead fixed from moving in a media feed direction and spanning a width of a printing zone in a subscan direction for depositing ink onto a surface of the sheet of media to form a print swath across a portion of a width of the sheet of media being processed in the ink jet printer. A gloss sensor is positioned downstream of the printhead for scanning the print swath formed on the surface of the sheet of media. The gloss sensor provides an output response corresponding to an amount of specular reflection received from the print swath. A controller in operative communication with each of the printhead and the gloss sensor is configured to control the operation of the printhead to effect printing of the print swath on the sheet of media as it moves past the printhead in a media feed direction and is further configured to process the output response of the gloss sensor of the scanned print swath of the printed image to determine if the printed sheet of media is moveable without smearing.

The ink jet printer may further comprise a media sensor disposed along a media path within the printer and in operative communication with the controller for determining the type of media used wherein a scan interval for scans by the gloss sensor of the print swath is chosen by the controller based on the determined type of media. In a further embodiments, the gloss sensor comprises a scan bar fixed in positioned downstream of the printhead in the media feed direction and having a length disposed across the width of the printing zone for scanning a portion of the print swath. In a further form, the controller is further configured to move the gloss sensor to a highest percent coverage line within a last printed portion of the print swath to be scanned prior to scanning the print swath with the gloss sensor.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings.

DETAILED DESCRIPTION

Figure 1:
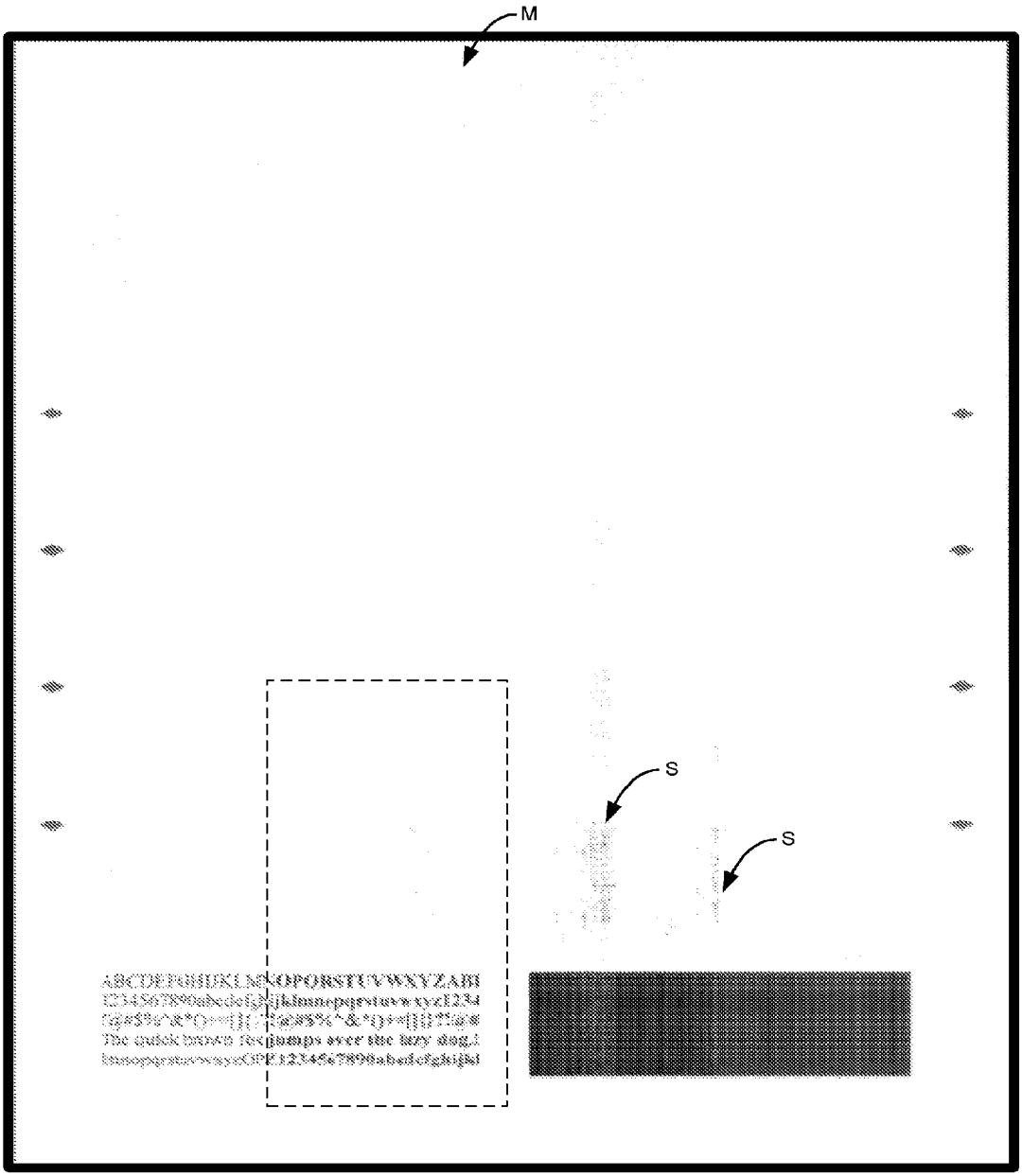
FIG. 1 is a sheet of printed media of an inkjet printing showing common smearing problems.
Figure 2:
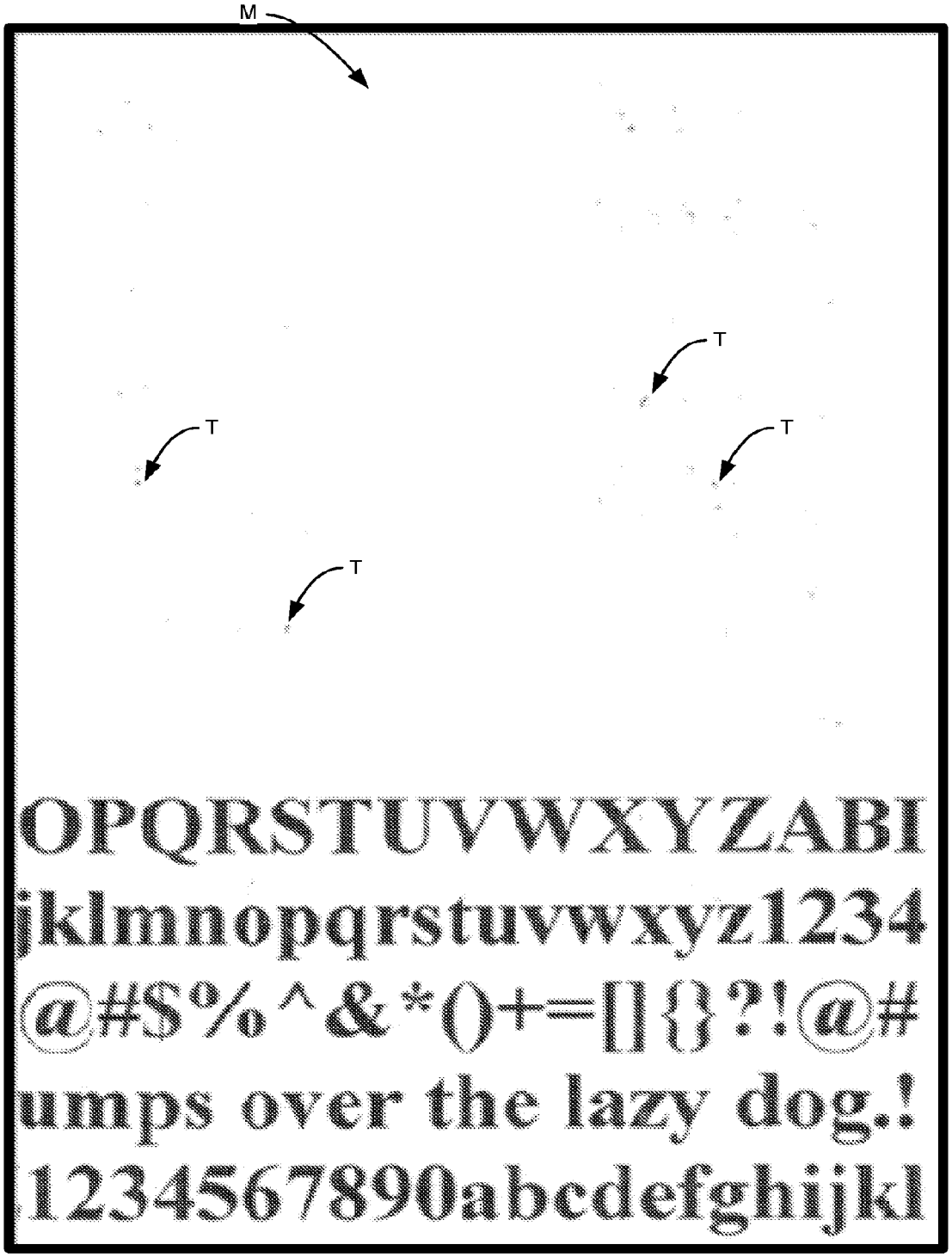
FIG. 2 is an expanded section, shown in dashed lines, on FIG. 1 showing an ink transfer.

It is to be understood that the invention is not limited in its application to the details of construction and the arrangement of components set forth in the following description or illustrated in the drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless limited otherwise, the terms "connected," "coupled," and "mounted," and variations thereof herein are used broadly and encompass direct and indirect connections, couplings, and mountings. In addition, the terms "connected" and "coupled" and variations thereof are not restricted to physical or mechanical connections or couplings.

In addition, it should be understood that embodiments of the invention include both hardware and electronic components or modules that, for purposes of discussion, may be illustrated and described as if the majority of the components were implemented solely in hardware. However, one of ordinary skill in the art, and based on a reading of this detailed description, would recognize that, in at least one embodiment, the electronic based aspects of the invention may be implemented in software. As such, it should be noted that a plurality of hardware and software-based devices, as well as a plurality of different structural components may be utilized to implement the invention. Furthermore, and as described in subsequent paragraphs, the specific mechanical configurations illustrated in the drawings are intended to exemplify embodiments of the invention and that other alternative mechanical configurations are possible.

Figure 3:
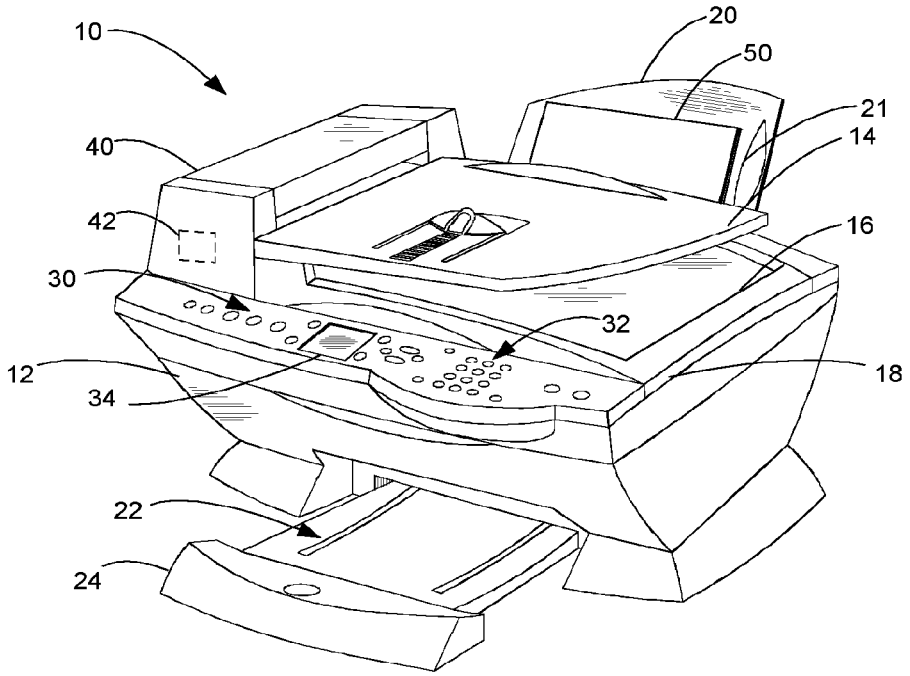
FIG. 3 is a perspective illustration of an example imaging apparatus embodying the present invention.
Figure 4:
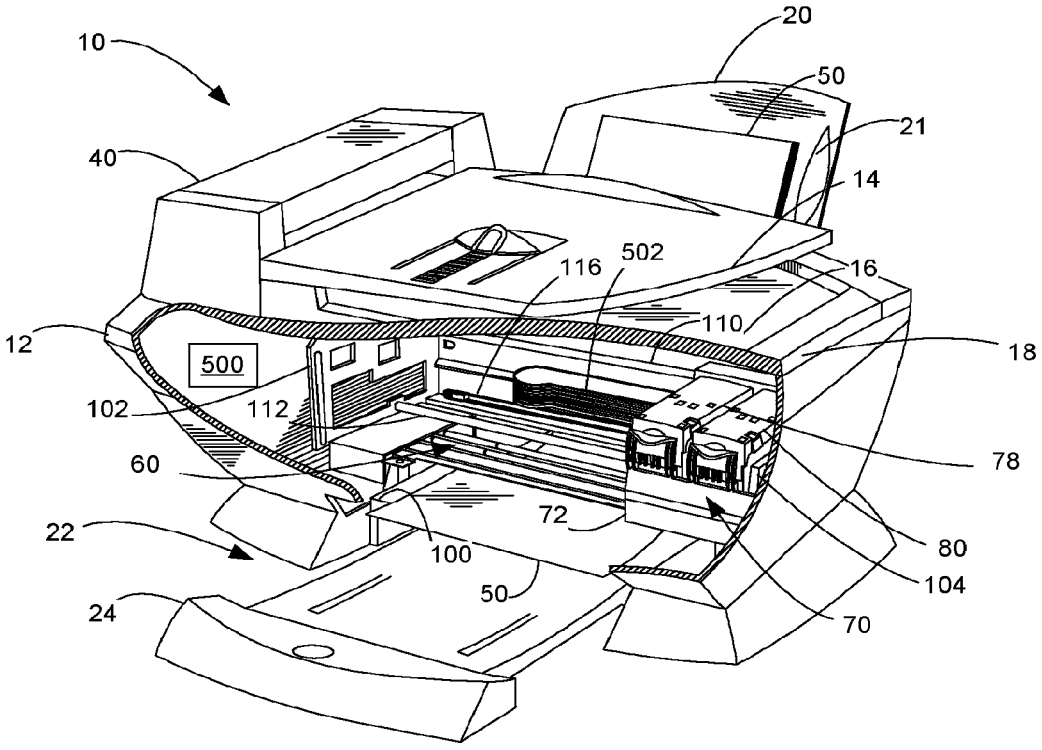
FIG. 4 is a cutaway perspective illustration of the example imaging apparatus of FIG. 3.
Figure 5:
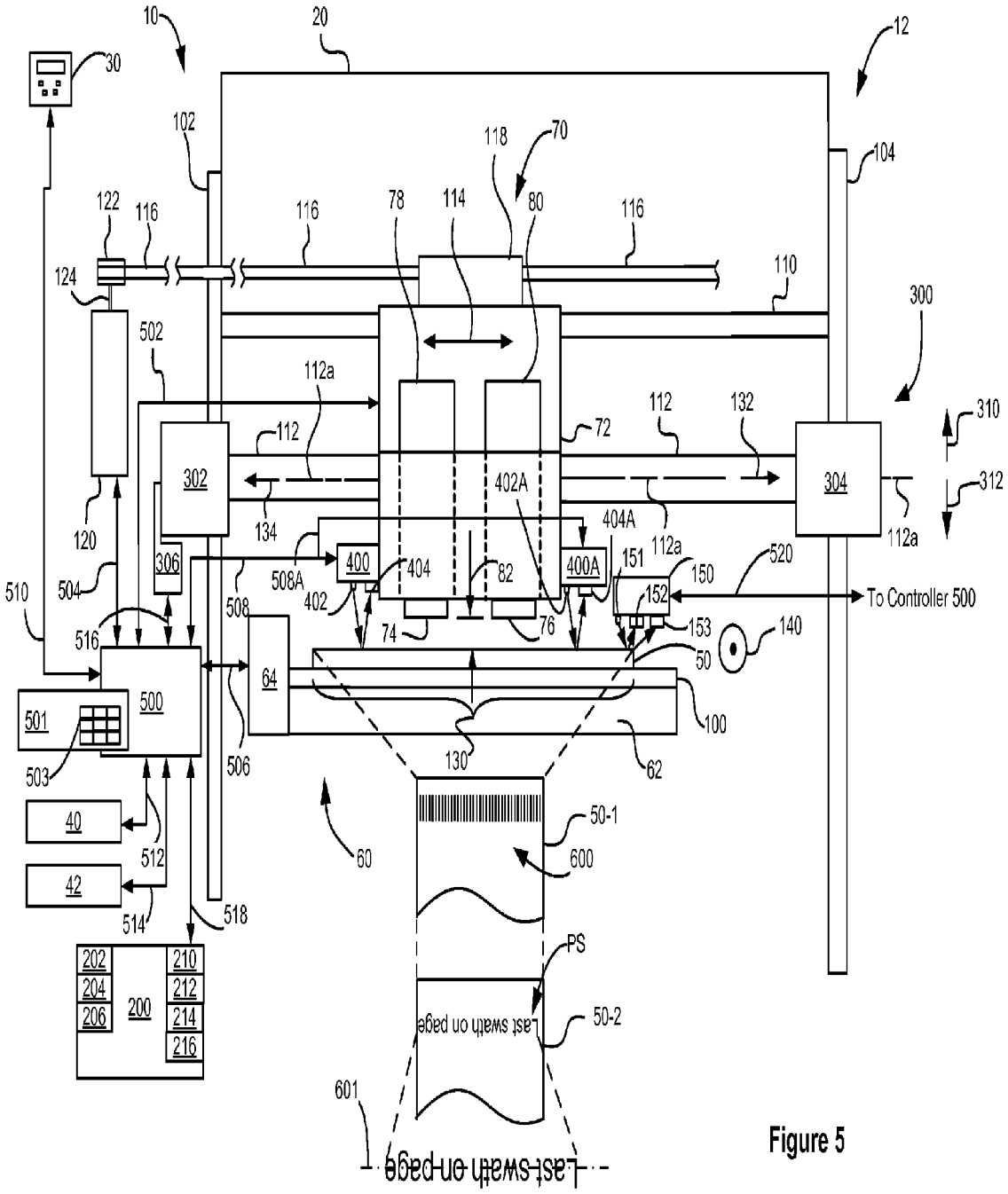
FIG. 5 is a schematic representation of an imaging apparatus embodying the present invention, and including a gloss sensor mechanism.

Referring now to the drawings and particularly to FIGS. 3-5, there is shown an imaging system 10 embodying the present invention. Imaging system 10 may be connected to a computer 200 (see FIG. 5) either directly or indirectly through a computer network. Imaging system 10 includes an imaging apparatus in the form of an inkjet printer 12. Imaging system 10 may further include an automatic document feeder (ADF) 40 and scanner 42 in which case it would be referred to as an All-In-One machine (AIO), also sometimes referred to as a multi-function imaging apparatus, and may operate as a standalone unit that has copying, scanning, and/or faxing functionality, in addition to printing. Document input and output areas 14, 16, are provided on openable lid 18. A second scanner such as a flat bed scanner and document scan bed (not shown) may be provided within inkjet printer 12 below lid 18. A media input area 20 is provided to support one or more sheets of media 50 to be printed. A printed media output area 22, such as extendable tray 24, is provided to support the printed media. An operator panel 30 having multiple input control buttons and keypad 32 and a display 34 is provided on inkjet printer 12 to allow a user to select options, such as for example paper type, paper size, etc. and control operations, such as for example, color or black and white printing, scanning, copying, or faxing, of imaging system 10 and to inform a user of the operation of imaging system 10 and provide a user with status information such as low ink, paper jam, etc.

Within the interior of inkjet printer 12, is a sheet feed unit 60, a printhead carrier system 70, a mid-frame 100, a side frame 102, a side frame 104 and a ink printhead gap adjustment mechanism 300, an alignment sensor 400 and a controller 500 (See FIG. 5).

Media input area 20 includes a media edge guide 21 and receives a plurality of sheets of media from which a sheet of media 50 is picked and transported by sheet feed unit 60 during an imaging operation. The sheet of media 50 may be, for example, plain paper, coated paper, photo paper or transparency media.

Printhead carrier system 70 includes a printhead carrier 72 for mounting and carrying a color printhead 74 and/or a monochrome printhead 76 (see FIG. 5). A color ink reservoir 78 is provided in fluid communication with color printhead 74, and a monochrome ink reservoir 80 is provided in fluid communication with monochrome printhead 76. Those skilled in the art will recognize that color printhead 74 and color ink reservoir 78 may be formed as individual discrete units, or may be combined as an integral unitary printhead cartridge. Likewise, monochrome printhead 76 and monochrome ink reservoir 80 may be formed as individual discrete units, or may be combined as an integral unitary printhead cartridge. Additionally, color ink reservoir 78, and monochrome ink reservoir 80 may be mounted off of printhead carrier system 70 and be in fluid communication with respective color printhead 74 and monochrome printhead 76 via tubing.

Referring now to FIG. 5, printhead carrier 72 is guided by guide members 110, 112, which are arranged in a parallel manner. Guide member 110 may be, for example, a guide rail tab fixedly mounted to side frames 102, 104. Guide member 112 may be a guide rod that is movably mounted to side frames 102, 104, and in positional communication with printhead gap adjustment mechanism 300. Guide member 112 includes a horizontal axis 112*a*. The horizontal axis 112*a* of guide member 112 generally defines a bi-directional scan path 114, also referred to as main scan direction 114, for printhead carrier 72. Accordingly, horizontal axis 112*a* and bi-directional scan path 114 are associated with each of printheads 74, 76 and printhead alignment sensor 400.

Printhead carrier 72 is connected to a carrier transport belt 116 via a carrier drive attachment device 118. Carrier transport belt 116 is driven by a carrier motor 120 via a carrier pulley 122. Carrier motor 120 has a rotating carrier motor shaft 124 that is attached to carrier pulley 122. Carrier motor 120 may be, for example, a direct current (DC) motor or a stepper motor. At the directive of controller 500, printhead carrier 72 is transported in a reciprocating manner along guide members 110, 112 and in turn, along bi-directional scan path 114.

The reciprocation of printhead carrier 72 transports inkjet printheads 74, 76 and printhead alignment sensor 400 across the sheet of media 50 along bi-directional scan path 114 to define a print/sense zone 130 of inkjet printer 12. The reciprocation of printhead carrier 72 occurs along bi-directional scan path 114, and is also commonly referred to as the horizontal direction, including a left-to-right carrier scan direction 132 and a right-to-left carrier scan direction 134. Generally, during each scan of printhead carrier 72 while printing or sensing, the sheet of media 50 is held stationary by sheet feed unit 60.

Mid-frame 100 provides support for the sheet of media 50 when the sheet of media 50 is in print/sense zone 130, and in part, defines a portion of a print medium path of inkjet printer 12.

Sheet feed unit 60 includes a feed roller 62 and corresponding index pinch rollers (not shown). Feed roller 62 is driven by a drive unit 64. The index pinch rollers apply a biasing force to hold the sheet of media 50 in contact with the respective driven feed roller 62. Drive unit 64 includes a drive source, such as a stepper motor, and an associated drive mechanism, such as a gear train or belt/pulley arrangement. Sheet feed unit 60 feeds the sheet of media 50 in a forward sheet feed direction 140, designated as a dot in a circle to indicate that the sheet feed direction is out of the plane of FIG. 5 toward the reader. The sheet feed direction 140 is perpendicular to the horizontal bi-directional scan path 114, and in turn, is perpendicular to the horizontal carrier scan directions 132, 134.

A media sensor 150 as is known in the art may also be provided within inkjet printer 12 disposed along a media path, including in the media input area 20, to provide a signal to controller 500 indicating the type of media for sheet of media 50. Media sensor is similar to alignment sensor 400. Media sensor 150 has a light source 151, such as an LED 151 and two photoreceptors, 152, 153. Photoreceptor 152 is aligned with the angle of reflection of the light rays from LED 151. Photoreceptor 152 receives specular light reflected from the surface of the sheet of media and produces an output signal related to amount of specular light reflected. Photoreceptor 153 is positioned off of the angle of reflection to receive diffuse light reflected from the surface of the media and produces an output related to the amount of diffused light received. Controller 500 by ratioing the output signals of photoreceptors 152, 153, can determine the type of media. For purposes of illustration only, media sensor 150 is shown adjacent mid-frame 100; however, the media sensor 150 would be positioned upstream of the print zone 130 such as in the media input area 20 so that media type can be determined prior to printing.

Controller 500 may be formed, for example, as an application specific integrated circuit (ASIC), and may include a processor, such as a microprocessor, and associated memory 501. Memory 501 may be any volatile or non-volatile memory or a combination thereof such as, for example, random access memory (RAM), read only memory (ROM), flash memory and/or non-volatile RAM (NVRAM). Alternatively, memory 501 may be in the form of a separate electronic memory (e.g., RAM, ROM, and/or NVRAM), a hard drive, a CD or DVD drive, or any memory device convenient for use with controller 500.

Controller 500 is communicatively coupled to printheads 74, 76 via a communication link 502. Controller 500 is communicatively coupled to carrier motor 120 via a communication link 504. Controller 500 is communicatively coupled to drive unit 64 via a communication link 506. Controller 500 communicatively coupled to printhead alignment sensor 400 via a communication link 508. Controller 500 is communicatively coupled to control panel 30 via a communication link 510. Controller 500 is communicatively coupled to automatic document feeder 40 via a communication link 512 and to scanner 42 via a communication link 514. Controller 500 may also be communicatively coupled to media sensor 150 via communication link 520. As used herein, the term "communication link" generally refers to a structure that facilitates electronic communication between two components, and may operate using wired or wireless technology. Accordingly, a communication link may be a direct electrical wired connection, a direct wireless connection (e.g., infrared or r.f.), or a network connection (wired or wireless), such as for example, an Ethernet local area network (LAN) or a wireless networking standard, such as IEEE 802.11. Although separate communication links are shown between controller 500 and the other controlled elements, a single communication link can be used to communicatively couple the controller 500 to all of the controlled elements such as printheads 74, 76, carrier motor 120, drive unit 64, etc.

Controller 500 executes program instructions stored in memory 501 to effect the printing of an image on the sheet of media 50, such as for example, by selecting the index feed distance of sheet of media 50 along forward sheet feed direction 140 as conveyed by feed roller 62, controlling the acceleration rate and velocity of printhead carrier 72, and controlling the operations of printheads 74, 76, such as for example, by controlling the firing frequency of individual nozzles of printhead 74 and/or printhead 76. A look up table 503 for storing various values such as media type and variables may be provided in memory 501. As used herein, the term "firing frequency" refers to the frequency of successive firings of a nozzle of a printhead in forming adjacent dots on the same scan line of an image.

In addition, controller 500 executes instructions to print printhead alignment patterns on a sheet of print media, such as the sheet of media 50-1, and to determine compensation values based on a reading of the printhead alignment patterns by the alignment sensor 400 for reducing dot placement errors during printing, such as for example, for reducing bi-directional dot placement errors by performing bi-directional printhead alignment. Bi-directional printhead alignment may be individually performed on each of printheads 74, 76. One example of a bi-directional printhead alignment pattern 600 is formed by printing a first plurality of laterally spaced bars in scan direction 132, printing a second plurality of laterally spaced bars in scan direction 134 interleaved with the first plurality of laterally spaced bars, determining an amount of bi-directional misalignment of dot placement based on bar spacing and/or overlap, and determining a bi-directional alignment value, e.g., a time delay value, a time advance value, a position delay value, or position advance value, that may be used to represent and correct for the determined amount of bi-directional misalignment.

Printhead gap adjustment mechanism 300 is used to adjust a printhead gap 82, i.e., the spacing, between printheads 74, 76, and the top surface of the sheet of media 50. Printhead gap adjustment mechanism 300 may include, for example, an active adjuster 302, a passive adjuster 304, and a drive mechanism 306. In one embodiment, for example, each of active adjuster 302 and passive adjuster 304 may include an eccentric cam to lift (i.e., move in direction 310) or lower (i.e., move in direction 312) guide member 112, and in turn, raise or lower, respectively, printheads 74, 76 and printhead alignment sensor 400 in relation to a surface of the sheet of media 50. In another embodiment, for example, passive adjuster 304 may be fixed, i.e., merely provide a pivot point, wherein guide member 112 may be leveled in relation to a surface of the sheet of media 50 by actuation of active adjuster 302.

Drive mechanism 306 is drivably coupled to active adjuster 302 and may include, for example, an electrically driven actuator, such as a motor or solenoid communicatively coupled to controller 500 via communication link 516, or may include a mechanically driven actuator, such as a ratchet mechanism, that is operated by being repeatedly bumped by printhead carrier 72, that rotates the eccentric cam of active adjuster 302, which may be followed by the eccentric cam of passive adjuster 304 in some embodiments, to lift or lower guide member 112.

A more detailed discussion of the operation of printhead gap adjustment mechanism 300 may be found in U.S. Pat. No. 7,445,302, entitled "METHODS FOR DETERMINING A PRINTHEAD GAP IN AN INKJET APPARATUS THAT PERFORMS BI-DIRECTIONAL ALIGNMENT OF THE PRINTHEAD", issued Nov. 4, 2008 and assigned to the assignee of the present invention.

In embodiments that include computer 200, inkjet printer 12 and controller 500 may be communicatively coupled to computer 200 via communication link 518. In embodiments including computer 200, computer 200 may be, for example, a personal computer including a display device 202, an input device 204 (e.g., keyboard), a processor 206, input/output (I/O) interfaces 210, memory 212, such as RAM, ROM, NVRAM, and a mass data storage device 214, such as a hard drive, CD-ROM and/or DVD units. During operation, computer 200 includes in its memory 212 a software program including program instructions that function as a printer driver 216 for inkjet printer 12. The printer driver 216 is in communication with inkjet printer 12 and controller 500 via communications link 518. The printer driver 216, for example, includes a halftoning unit and a data formatter that places print data and print commands in a format that can be recognized by inkjet printer 12. In a network environment, communications between computer 200 and inkjet printer 12 may be facilitated via a standard communication protocol, such as the Network Printer Alliance Protocol (NPAP).

Printhead carrier system 72 further includes a sensor for sensing the gloss of the ink placed on the recording medium. In one form the sensor may be a printhead alignment sensor 400 attached to printhead carrier 72 which is used for two functions. First, printhead alignment sensor 400 may be used, for example, during scanning of a printhead alignment pattern, such as printhead alignment pattern 600 shown in a projection of the sheet of media 50-1 in FIG. 5. Printhead alignment sensor 400 may be, for example, a unitary optical sensor including a light source 402, such as a light emitting diode (LED), and a reflectance detector 404, such as a phototransistor. The reflectance detector is located on the same side of a media as the light source. The operation of such sensors is well known in the art, and thus, will be discussed herein to the extent necessary to relate the operation of printhead alignment sensor 400 to the operation of the present invention. For example, the LED 402 of printhead alignment sensor 400 directs light at a predefined angle of incidence onto a reference surface, such as the surface of sheet of media 50, and at least a portion of light reflected from the surface is received by the reflectance detector 404 of printhead alignment sensor 400 that is positioned along the angle of reflection. The intensity of the reflected light received by the reflectance detector 404 varies with the density of a printed image present on sheet of media 50. The light received by the reflectance detector 404 of printhead alignment sensor 400 is converted to an electrical signal by the reflectance detector 404 of printhead alignment sensor 400. The signal generated by the reflectance detector 404 corresponds to the reflectivity from sheet of media 50 and the ink deposited thereon, and the reflectivity of the printhead alignment pattern 600, scanned by printhead alignment sensor 400.

The second function of printhead alignment sensor 400 is to sense the gloss of the ink that has been deposited on the recording medium by printheads 74, 76, and in one form, the ink in a swath printed on the sheet of media 50, such as the last print swath, or in another form the densest swath printed on the sheet of media 50. As illustrated in FIG. 5, print swath PS is shown on sheet of media 50-2 and is representative of a print swath PS, such as the last print swath PSL to be printed on that side of the sheet of media 50-2 before it leaves the print zone 130 or the densest print swath printed anywhere on that side of the sheet of media 50-2.

Shown within print swath PS is an optimum position indicated by the line 601 along which printhead alignment sensor 400 will traverse to determine the glossiness of print swath PS in one example embodiment as will be later explained. The height of print swath PS is generally greater than the area scanned by the printhead alignment sensor 400. The height of print swath PS is along the media feed direction 140 and is also referred to as the subscan direction which is orthogonal to the scan direction along scan path 114. Different scan positions in the subscan direction would have different percent coverages or print densities based on the content in the print swath to be scanned. The optimum position 601 may be based on at least one of ink formulation, media type, and environmental conditions. Prior testing of the printer may reveal that a predetermined coverage or density such as for example 50 percent coverage or 50 percent density may be optimum for a certain combination of ink formulation, media type, and environmental condition. The optimum percent coverage or density may be a set predetermined value that is based on expected ink formulations, media types, or environmental conditions to be involved. Alternatively, the optimum percent coverage or density may also be a dynamically adjusted value based on media types and environmental conditions that are present at time of printing. The optimum position 601 would be that scan position in the subscan direction that is closest to the optimum percent coverage or density based on the known content of that print swath.

The optimum position 601 may be determined empirically by having the gloss sensor scan the entire width of print swath PS in two or more passes, determining which pass provided the greatest signal to noise ratio and then performing the reminder of the methods described further herein. For example, the height of print swath PS may be 30 mm while the width of the area scanned may be 10 mm indicating that 3 passes by printhead alignment sensor 400 would be needed. The pass having the highest signal to noise ratio would be used as the optimum position 601. In another form the optimum position 601 may be determined by comparing a scan by the printhead alignment sensor 400 to see if it exceeds a predetermined threshold such as 50 percent coverage or 50 percent density. The first scan of the multiple scans of print swath PS to exceed this predetermined threshold would then be used as the optimum position 601.

The higher the gloss, the higher the specular reflection and the wetter the ink is. As the ink dries or is absorbed by the medium, the specular reflection diminishes until a steady state level of reflection occurs. The steady state level may be determined by looking at the differential change in the sensed specular reflection between success scans of the swath PS. If the differential change in specular reflection is within a predetermined threshold, the ink on the medium would be deemed to be dry enough to avoid smearing during subsequent printer operations.

It should be understood that while it is advantageous to have printhead alignment sensor 400 perform the ink gloss sensing, a separate sensor, such as gloss sensor 400A may be provided printhead carrier 72. Gloss sensor 400A would also be in electrical communication with controller 500 via communication link 508A which may be part of communications link 508 or be a separate link. Gloss sensor 400A would, in one example embodiment, be the same type of sensor as used for printhead alignment sensor 400 having a light source 402A and reflectance detector 404A.

Figure 6:
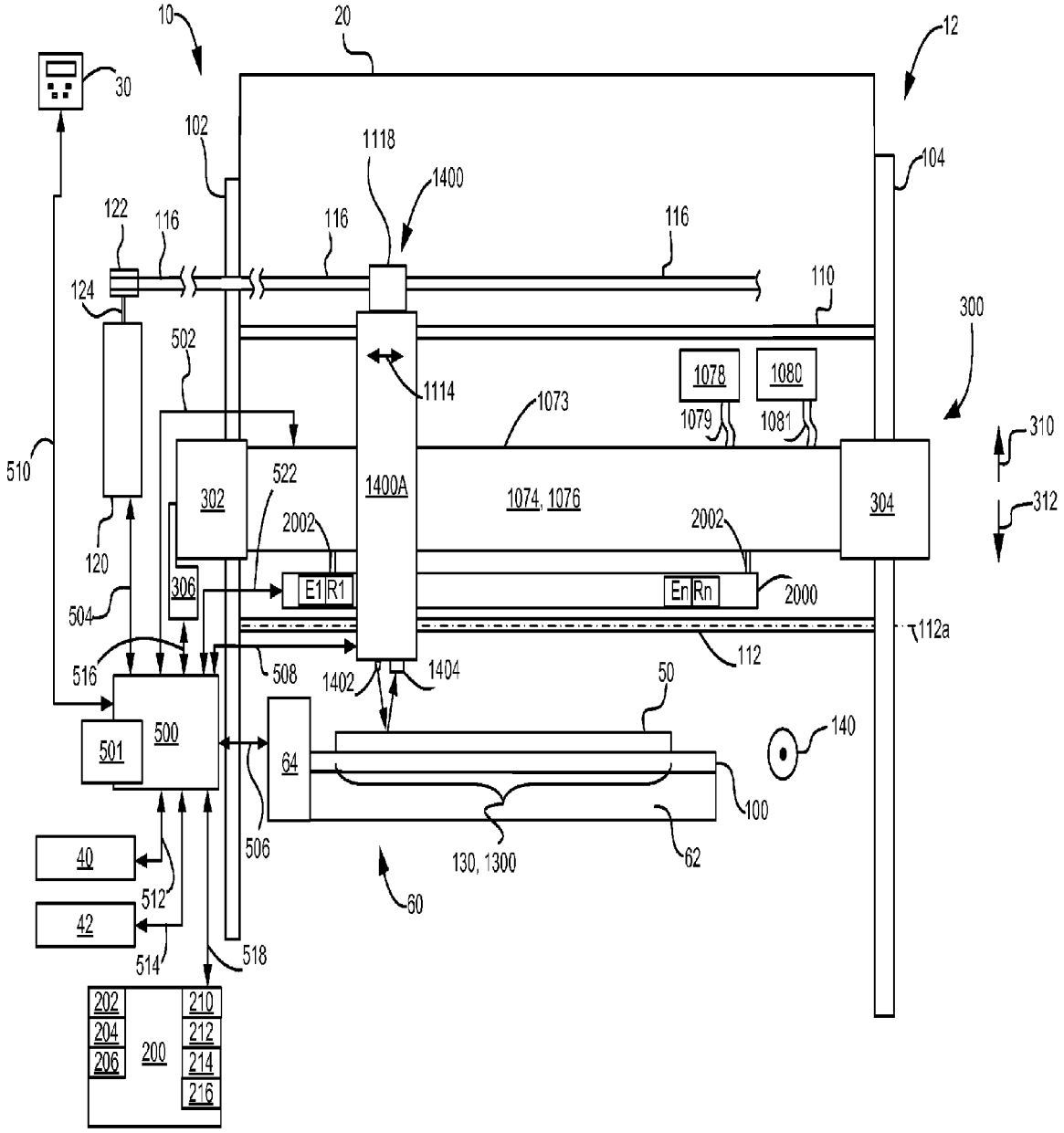
FIG. 6 is a schematic representation of the imaging apparatus shown in FIG. 5 but utilizing a stationary page wide printhead and a movable gloss sensor mechanism.

Shown in FIG. 6 is another arrangement of imaging system 10 utilizing a stationary or non-reciprocating printhead and a reciprocating gloss sensor. Imaging system 10 includes inkjet printer 12, an ADF 40, and scanner 42. Operator panel 30 is provided. Within the interior of inkjet printer 12, is sheet feed unit 60, mid-frame 100, side frame 102, side frame 104, an optional ink printhead gap adjustment mechanism 300, controller 500, stationary printhead assembly 1073, and gloss sensor assembly 1400. Computer system 200 may also be in communication with imaging system 10 and inkjet printer 12. The foregoing components function as previously described with respect to FIGS. 3-5.

Page-wide stationary printhead assembly 1073 includes monochrome and color printheads 1074, 1076 positioned above a sheet of media 50 supported on mid-frame 100 in print zone 130. Printhead assembly 1073 is shown coupled to ink printhead gap adjust mechanism 300 to allow the gap between printhead assembly 1073 and a sheet of media 50 to be adjusted. Color and monochrome printheads 1074, 1076 span approximately the width of mid-frame 100 allow a complete print swath PS to be printed across the width on a sheet of media 50. The sheet of media 50 would be moved at a constant velocity beneath printhead assembly 1073 by sheet feed unit 60 resulting in essentially a single swath being printed on a side of the sheet of media in the media feed direction. Color and monochrome ink reservoirs 1078 and 1080 are in fluid communication via conduits or tubing 1079, 1081 with printhead assembly 1073 to supply color and monochrome printheads 1074, 1076, respectively. Printheads 1074, 1076 are communicatively coupled to controller 500 via communications link 522. Controller 500 controls the firing of printheads 1074, 1076 to deposit ink onto media 50.

Gloss sensor assembly 1400 is guided by guide members 110, 112, which are arranged to be parallel. Guide members 110, 112 may be fixedly mounted and may be, for example, a guide rail tab fixedly mounted to side frames 102, 104. Guide member 112 may be a guide rod that is movably mounted to side frames 102, 104, and in positional communication with printhead gap adjustment mechanism 300 as previous described. Guide member 112 includes a horizontal axis 112*a*. The horizontal axis 112*a* of guide member 112 generally defines a bi-directional scan path 1114, also referred to as main scan direction 1114, for gloss sensor assembly 1400. Accordingly, horizontal axis 112*a* and bi-directional scan path 1114 are associated with gloss sensor assembly 1400 and gloss sensor 1400A. Gloss sensor 1400A has a light source 1402 and reflectance detector 1404 functioning in a substantially similar manner as previously described for light source 402 and reflectance detector 404 of print alignment sensors 400 or those respective elements of gloss sensor 400A. Gloss sensor 1400A would also be in electrical communication with controller 500 via communication link 508 providing an output signal representative of the gloss of the ink deposited onto sheet of media 50.

Gloss sensor assembly 1400 is connected to a carrier transport belt 116 via a carrier drive attachment device 1118 in a similar fashion to printhead carrier 72 and carrier drive attachment 118 shown in FIGS. 3-5. Carrier transport belt 116 is driven by a carrier motor 120 via a carrier pulley 122. Carrier motor 120 has a rotating carrier motor shaft 124 that is attached to carrier pulley 122. Carrier motor 120 may be, for example, a direct current (DC) motor or a stepper motor. At the directive of controller 500, gloss sensor assembly 1400 and gloss sensor 1400A are transported in a reciprocating manner along guide members 110, 112 and in turn, along bi-directional scan path 1114 across media 50.

The reciprocation of gloss sensor assembly 1400 transports gloss sensor 1400A across the sheet of media 50 along bi-directional scan path 1114 to define a sense zone 1300 within print zone 130 of inkjet printer 12. The reciprocation of gloss sensor assembly 1400 occurs along bi-directional scan path 1114, and is also commonly referred to as the horizontal direction. Generally, during each scan of gloss sensor assembly 1400 during sensing, the sheet of media 50 is held stationary by sheet feed unit 60.

Another example embodiment for gloss sensing is also illustrated in FIG. 6. In lieu of or, if desired, in combination with, gloss sensor assembly 1400, there is provided a scan bar 2000 mounted in inkjet printer 12 and positioned over and across the width of the print zone 130 above the sheet of media 50. Scan bar 2000 works in a similar manner to gloss sensor 400A. However scan bar 2000 has a plurality emitting light sources E1-En that are directed onto the upper surface of the sheet of media 50 and a corresponding plurality of corresponding photoreceptors R1-Rn to capture the reflected light. Scan bar 2000 may be a monochrome or color contract image sensor (CIS) or charge coupled device (CCD) type scan bar as is well known in the art. Because scan bar 2000 spans the width of the printing zone 130, the entire print swath PS is scanned at once obviating the need for reciprocation and the associated carrier transport belt 116, carrier motor 120, carrier pulley 122, communications link 504 and the software or firmware in controller 500 needed for their operation. Use of scan bar 2000 also reduces the time needed to analyze the gloss of the ink along the entire print swath PS. Scan bar 2000 may be mounted independently of stationary printhead assembly 1073 or be attached directly to it or by supports 2002. Scan bar 2000 may also be used in lieu of printhead alignment sensor 400, 400A shown in FIG. 5. Scan bar 2000 would be mounted adjacent to but downstream of printhead carrier 72 to accommodate for the reciprocation of printhead carrier 72. During scanning of the print swath by scan bar 2000 to determine gloss, the media may be moved a short amount (between about 3 to 10 millimeters) in the media feed direction.

When using a stationary printhead, because the height of the print swath can be a significant portion of the length of the sheet of media, when looking at the highest percent coverage line within the print swath, the controller will look to a last portion of the print swath that has been deposited on a side of the sheet of media. This last portion may be within the bottom 20 millimeters of the end of the print swath.

Figure 7:
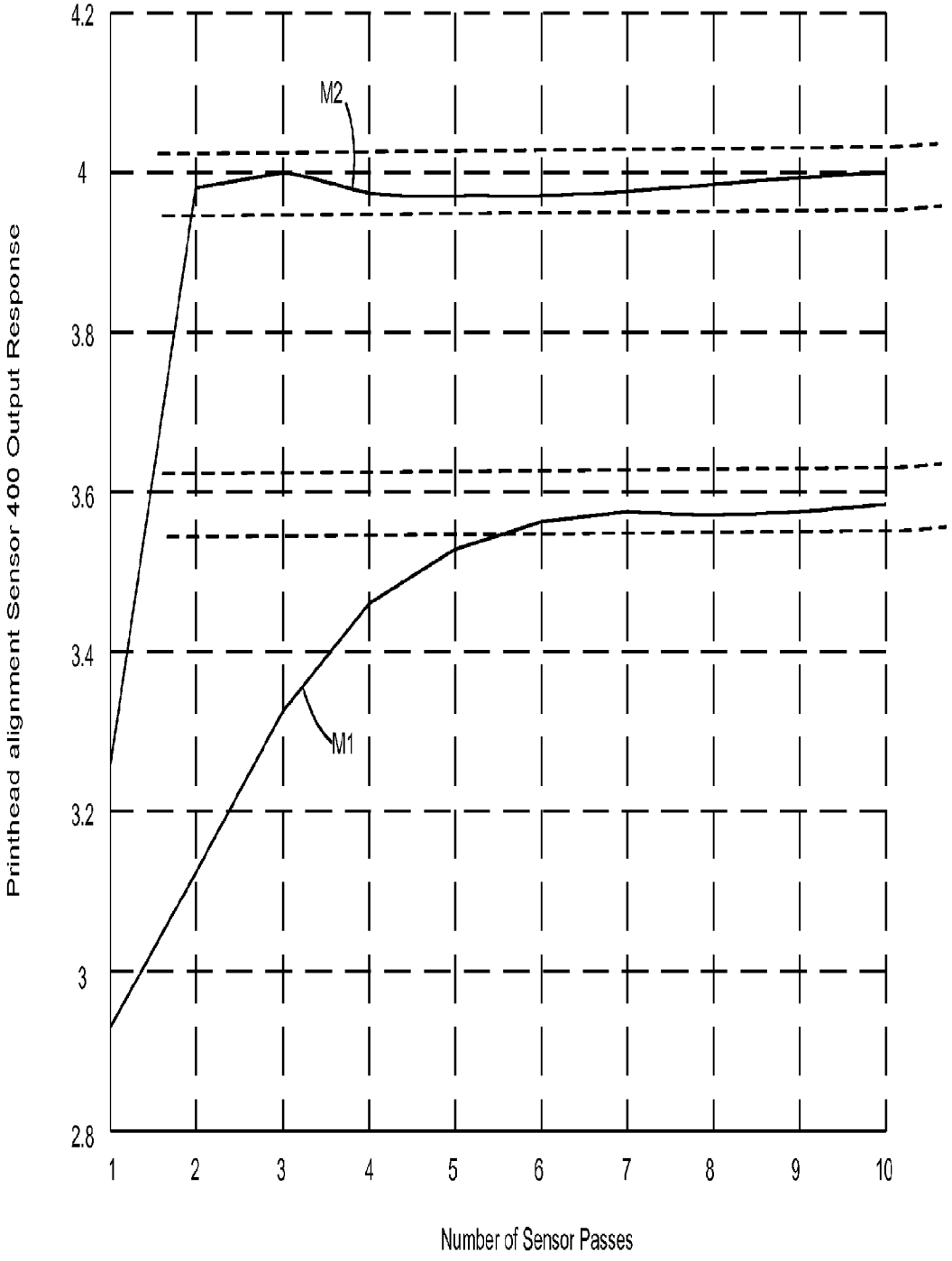
FIG. 7 is an example graph showing gloss sensor output response to ink applied to two different types of media.
Figure 8:
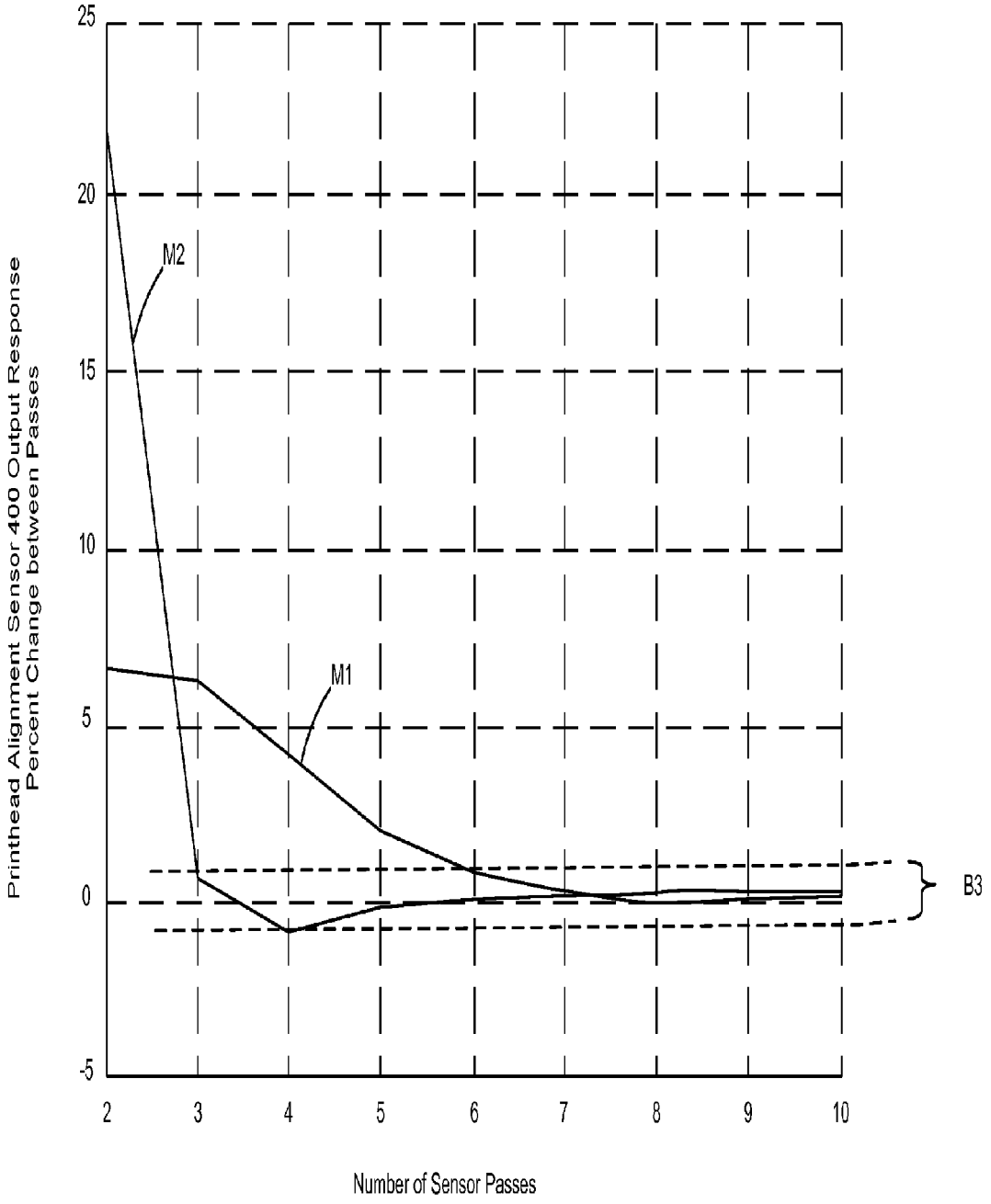
FIG. 8 is an example graph showing the rate of change in sensor output response as ink applied to two different types media shown in FIG. 6 dries.

FIGS. 7-8 illustrate the response of printhead alignment sensor 400 when used as a gloss sensor. In both figures, two media types, M1 and M2 are illustrated. Media M1 is HAMMERMILL TIDAL MP paper made by International Paper of Memphis, Tenn. and media M2 is X9 paper made by Boise, Inc. of Boise, Id.

To collect the data shown in FIGS. 7-8, a row of dark blocks was printed on each of the two media types M1, M2. For each media type, immediately after printing that row, it was scanned with the printhead alignment sensor 400 every two seconds. The raw data was thresholded and integrated over each pass, and the results for two different media are shown in FIG. 7. Each data point is the integrated result of a sensor pass.

In FIG. 7, a qualitative response for printhead alignment sensor 400 is on the Y-axis and the number of sensor passes made across the print swath is on the X-axis. It should be realized the term "sensor pass" means that the sensor 400, 400A, 1400A moves along the print swath PS across the sheet of media 50 or that for scan bar 2000, a scan is taken once every two seconds of the print swath PS. Each sensor pass was made two seconds apart, although shorter or longer times between passes may be used. On the Y-axis the higher the number the darker the measurement. As the ink is absorbed, it reflects less specular light and thus appears darker over time until it reaches a steady state value.

As shown, for media M2, the sensor output response of printhead alignment sensor 400 reaches a steady state value within indicated band B1 after two passes, whereas for media M1, the sensor output response for sensor 400 does not reach a steady state value within indicated band B2 until six passes have occurred. At steady state, the output response of printhead alignment sensor 400 is substantially constant and will vary about a nominal value that will be different for different media types. The ink can be considered sufficiently dry (absorbed) once the response of the printhead alignment sensor has reached a steady state condition. FIG. 7 illustrates that media M1 takes about 12 seconds to dry/absorb versus about four seconds for media M2.

In FIG. 8, the rate of change in the output response of printhead alignment sensor 400 is shown. Again the number of sensor passes is shown on the X-axis while the rate of change of sensor response is shown on the Y-axis. The first data point at 2 is measured on the second sensor pass as two passes are needed to obtain the percent change or difference. Similarly, the second data point at 3 occurs after the third pass has been made, and so on. Also indicated is a band B3 in which the rate of change of printhead alignment sensor 400 is within a predetermined value. As illustrated band B3 is positioned about a zero value. Again for media M2, its rate of change is within band B3 within three passes while media M1 enters band B3 sometime between the sixth and seventh pass of printhead alignment sensor 400. Thus, by either determining when printhead alignment sensor 400 output reaches a steady state value or when the rate of change of the output of printhead alignment sensor 400 falls within a predetermined range, such as band B3 about a zero value, ink dry time can be determined. In other words, the ink can be considered sufficiently dry (absorbed) once the percent change between measurements is below a specified threshold.

It will be appreciated that by determining when the ink is dry/absorbed throughput can be increased for media having shorter drying times while for media having longer dry times, throughput can be decreased so that smearing and streaking is avoided. This can be done without the user having to select a media type. Also, determining actual dry time, rather than using a default value for a given media type, allows for variation in dry time that may occur within sheets of a given media type or because of environmental conditions such as temperature and humidity.

Printhead alignment sensor 400, gloss sensors 400A, 1400A and 2000, will hereinafter now be collectively referred to as gloss sensor GS. Where explanatory material is applicable to one or more of the sensors but not all, the individual reference number for that sensor or sensors will be used.

Controller 500 may be provided with a sampling/integration circuit to determine when a steady state response for gloss sensor GS is reached or with a derivative circuit to determine when the rate of change in the sensor GS response falls within a predetermined band, such as band B3. Such circuit designs are well known to those of ordinary skill in the art and will not be presented here for purposes of brevity. The latter approach is advantageous in that the derivate approach is independent of the media type whereas the steady state approach values will change with media type. While a two second pause between scan was used, other time periods that are longer or shorter may be used. For example if a user selects a media type known to require a long time to have the deposited ink be absorbed or dry, i.e. a long "dry time" a scan pass interval may be chosen to be longer, such as five seconds, and, conversely for indicated media types known to have a shorter dry time, a shorter scan pass interval, such as one second, may be used. Also, based on results of previous scans, the scan interval may also be dynamically adjusted.

Figure 9A:
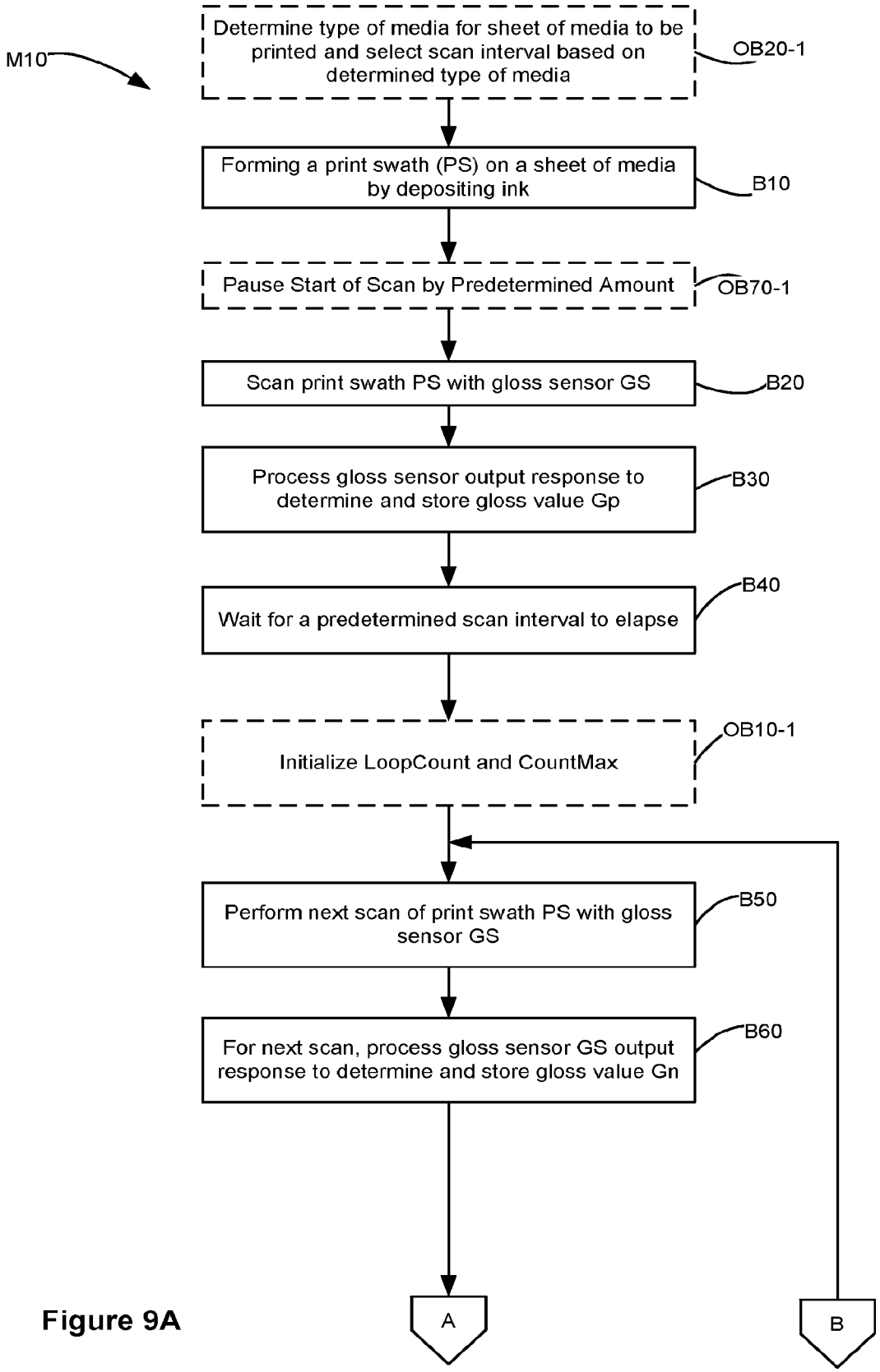
FIGS. 9A, 9B illustrate a flowchart for a method of determining dry time of a print swath.
Figure 9B:
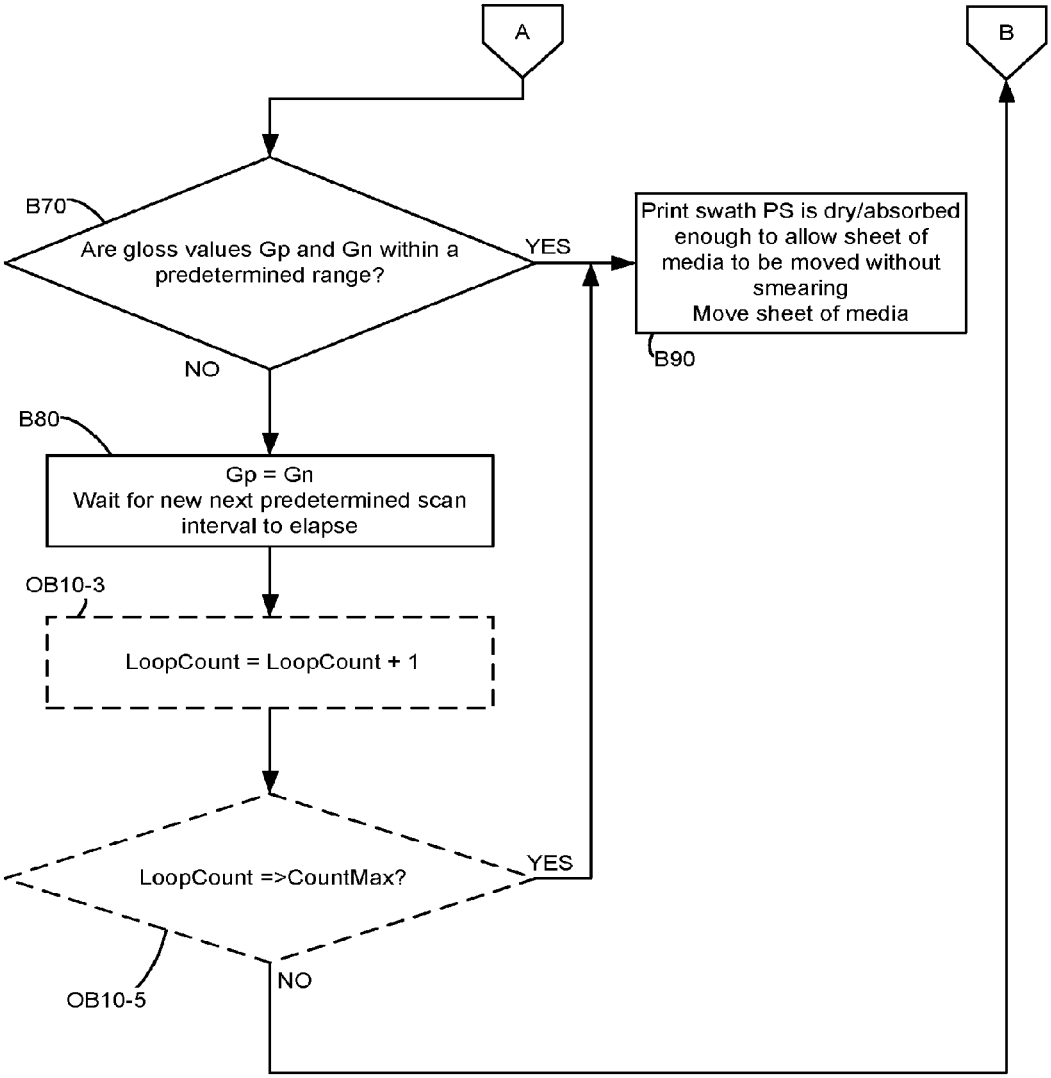

In view of the foregoing, FIG. 9 is a flowchart for a method M10 for determining the drying time of ink deposited on a sheet of media. Optional blocks in method M10 are designated by OB together with a reference numeral and dashed lines.

At block B10, in method M10, printheads 74, 76 or printheads 1074, 1076 under direction from controller 500 form a print swath PS on a sheet of media by depositing ink. Print swath PS may in one form be that last print swath PSL that is to be printed on that side of the sheet of media 50. Method M10 proceeds to block B20 where a scan of print swath PS is done by gloss sensor GS under direction from controller 500. Method M10 proceeds to block B30 where gloss sensor GS output response is processed by controller 500 to determine a gloss value Gp for the previous scan of print swath PS which gloss value Gp is then stored in memory 501.

Proceeding to block B40, method M10 waits for a predetermined scan interval to elapse. For example, controller 500 may start a count up or count down timer after the first scan of print swath PS is done or after the gloss value Gp is calculated that upon reaching the end of the predetermined scan interval outputs a signal to initiate a next scan of print swath PS by gloss sensor GS. Thereafter at block B50, in the method M10 controller 500 performs a next scan of print swath PS with gloss sensor GS and at block B60, the gloss sensor GS output response for the next scan is processed by controller 500 to determine a next gloss value Gn for the print swath PS which value is stored in memory 501.

At block B70, in method M10, a determination is made whether or not the values of Gp and Gn fall within a predetermined range. At block B70 the predetermined range for Gp and Gn may be one of a steady state response for a media type or one of where the absolute value of the difference between the values Gp and Gn is less than a predetermined threshold. If a NO determination is made, i.e., the values of Gp and Gn do not fall within the predetermined range, method M10 proceeds to block B80 where the value of Gp is replaced by the value of Gn and method M10 waits until the new next predetermined scan interval has elapsed. Thereafter method M10 loops back to block B50 where a new next scan is performed and proceeds back through blocks B60 and B70.

At block B80, if YES determination is made, i.e., the values of Gp and Gn fall within the predetermined range, method M10 proceeds to block B90 where print swath PS is considered as being dry or absorbed enough to allow the sheet of media to be moved without smearing and the sheet of media 50 can now undergo further processing such as being sent to a duplexer for printing on the reverse side, to a finisher for collation or stapling, or to a media output area.

In another form method M10 may include a loop counter to avoid a continuous looping situation. Such a loop counter is implemented by optional blocks OB10-1, OB10-3 and OB10-5. As illustrated the loop counter is a count-up type. As one of ordinary skill in the art would recognize the loop counter may be implemented as a count-down type. Optional block OB10-1 is illustrated as being placed between blocks B40 and B50. Optional block OB10-1 may also be placed anywhere prior to the loop back point from block 80. At optional block OB10-1, the variables LoopCount and CountMax are initialized. The variable LoopCount is the actual count of the scans that have been made of print swath PS. CountMax is a predetermined maximum loop count to limit the number of scans being done on print swath PS. Assuming that the scan interval is once every two seconds, CountMax may be set to 10 limiting the total drying time for swath PS to 20 seconds. Other values may be used. Optional blocks OB10-3, OB10-5 are inserted after block B80 in the loop back path to block B50. At optional block OB10-3, the variable LoopCount is incremented by one. At optional block OB10-5, a determination is made to see if the variable LoopCount equals or exceeds the variable CountMax. If YES, the method M10 proceeds to block B90. If NO, the method M10 proceeds back to block B50 to perform the next scan of the print swath PS.

A further form of method M10 is also shown in FIG. 9. At optional block OB20-1 inserted ahead of block B10, controller 500 determines a type of media to which sheet of media 50 belongs. Determination of the type of media may be based on user provided input or by use of a media sensor 150. The determination of the type of media may be used to set the predefined scan interval. It will be realized that if optional blocks OB10-1, OB10-3 and OB10-5 are also used in conjunction with optional block OB20, the determined media type can be used to set the variable CountMax and to set the length of predetermined scan interval. A lookup table 503 may be provided in memory 501 that lists media types with corresponding values of the variables CountMax and the length of the scan interval to be used in method M10. Optional block OB10-1 would be modified to initialize variable CountMax to a predetermined value based on the media type. If no media type can be determined, default values for the scan interval and Variable CountMax would be used.

Method M10 works well with printing of text. If high density printing is to take place, we have found that while method M10 is effective, it may be modified to adjust the drying times based on the density of printing that has occurred on that page. The higher the density or percent coverage, a greater volume of ink is being deposited on the sheet of media, increasing drying times. For example, a print swath comprised of solid color bar (representing 100 percent coverage of the print swath PS) printed across the sheet of media will take longer to dry than a print swath comprise of text (about 10 percent coverage) printed across the sheet of media. A solid color print swath PS would be 100 percent coverage. The solid color may be solid black, solid cyan, solid magenta, solid yellow or combinations of these colors where print swath PS has essentially no unprinted area. In testing, when media type M1 was printed with a solid black bar, it took 24 seconds to be sufficiently dry so that it would not smear when being duplexed. There was, however, less than a one percent change in the gloss sensor 400 output over the last 12 seconds. To accommodate for heavy density or high percent coverage method M10 may be modified in one of several ways as shown in FIGS. 10-11.

Figure 10:
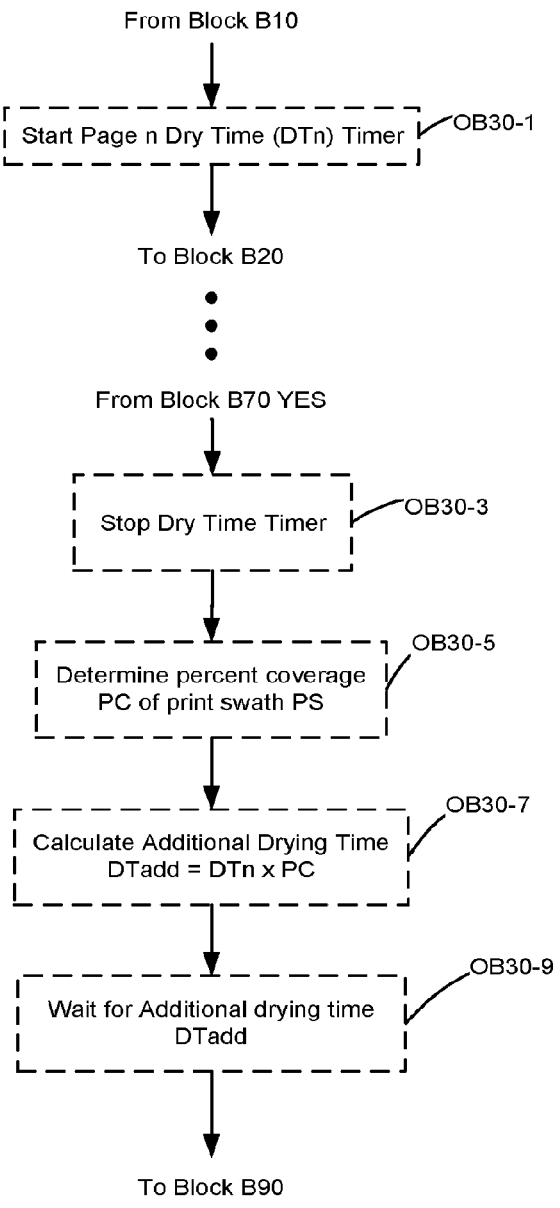
FIG. 10 is a flowchart of a modification to the method of FIGS. 9A-9B illustrating scaling of the scan interval based on the percent of coverage for a print swath.

FIG. 10 illustrates a first way of modifying method M10 to scale the drying time based on the density or percent coverage. After block B10, method M10 would proceed to optional block OB30-1 where a Page n dry time timer DTn is started. Method M10 proceeds back to block B20 and continues as previously described. Following Block B70 YES, method M10 proceeds to optional block OB30-3 where the Page n dry time timer DTn is stopped. Method M10 proceeds to optional block OB30-5 where the percent coverage PC of print swath PS is determined. At optional block OB30-7, method M10 calculates the additional drying time DTadd needed based on the percent coverage. As shown, DTadd is the Page n drying time DTn scaled by the percent coverage percentage PC. For example, if the percent coverage was 50% and DTn was 2 seconds then the additional drying time DTadd would be 1 second. At optional block OB30-9, method M10 waits the additional drying time DTadd determined in optional block OB30-7. Thereafter method M10 proceeds to Block B90.

Figure 11:
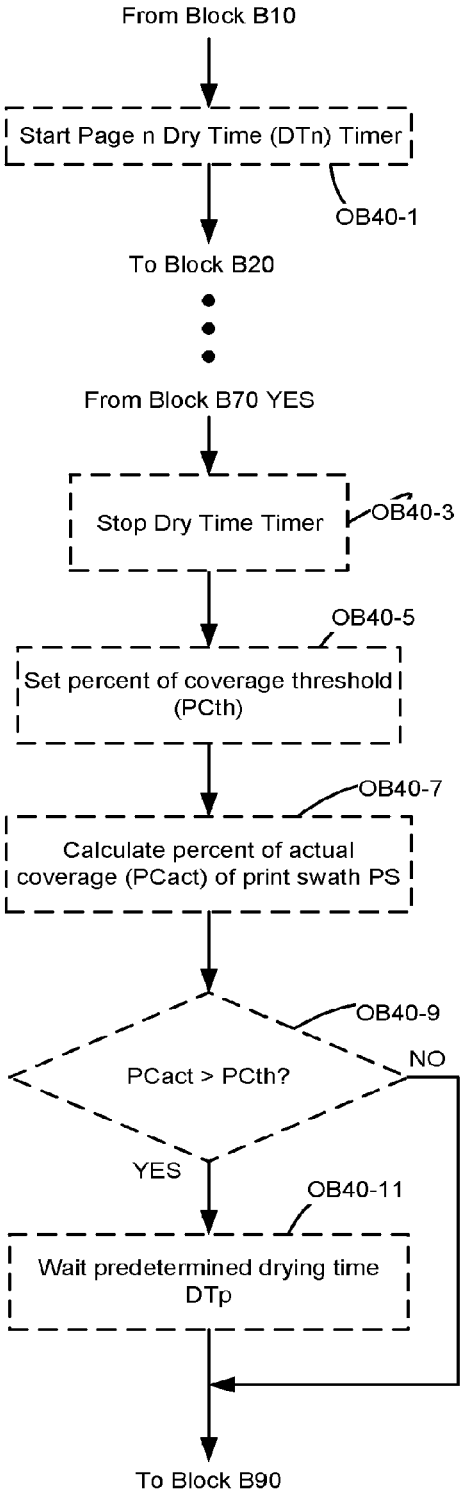
FIG. 11 is a flowchart of a modification to the method of FIGS. 9A-9B illustrating changing the scan interval when the percent of coverage for a print swath exceeds a predetermined threshold.

FIG. 11 illustrates a way of modifying method M10 to establish a predetermined density threshold or percent of coverage threshold above which a predetermined additional drying time is added. After block B10, method M10 would proceed to optional block OB40-1 where a Page n dry time timer DTn is started. Method M10 proceeds back to block B20 and continues as previously described. Following at determination at Block B70 that the values of Gp and Gn are within a predetermined range, method M10 proceeds to optional block OB40-3 where the Page n dry time timer DTn is stopped. Method M10 proceeds to optional block OB40-5 where a percent of coverage threshold PCth is set. Method M10 at optional block OB40-7 calculates an actual percent of coverage PCact of print swath PS.

At optional block OB40-9 a determination is made to see if the percent of actual coverage PCact is greater than the percent of coverage threshold PCth. If YES, method M10 proceeds to optional block OB40-11 where method M10 waits a predetermined drying time DTp and then method M10 returns to block B90. If NO, method M10 proceeds to block B90.

Figure 12:
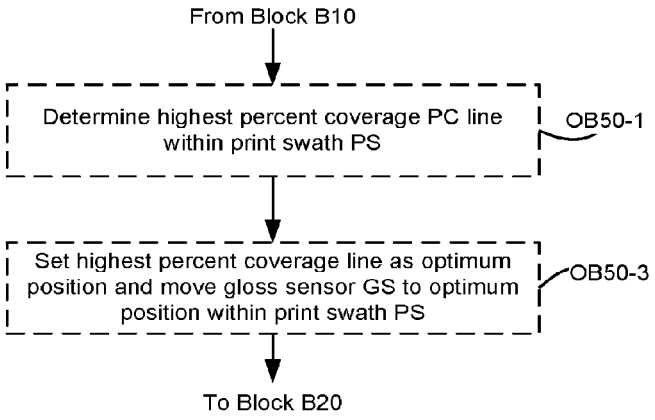
FIG. 12 is a flowchart of a modification to the method of FIGS. 9A-9B illustrating determining the optimum position for the gloss sensor within a print swath to perform a scan of the print swath.

FIG. 12 illustrates a way of modifying method M10 to position the gloss sensor GS at an optimum position 601 within the print swath PS. One criteria for determining the optimum position is to determine the line or portion within print swath PS that has the highest percent coverage or highest density. Controller 500 would have the data for accomplishing this as it also controls the firing of the printheads 74, 76, 1074, 1076. After block B10, the method M10 would go to optional block OB50-1 where the highest percent coverage line within print swath PS is determined by the controller 500. Next at optional block OB50-3, the highest percent coverage line is set as the optimum position for gloss sensor GS along which to scan print swath PS and the gloss sensor GS is moved to the optimum position. The method M10 would then return to block B20.

Figure 13:
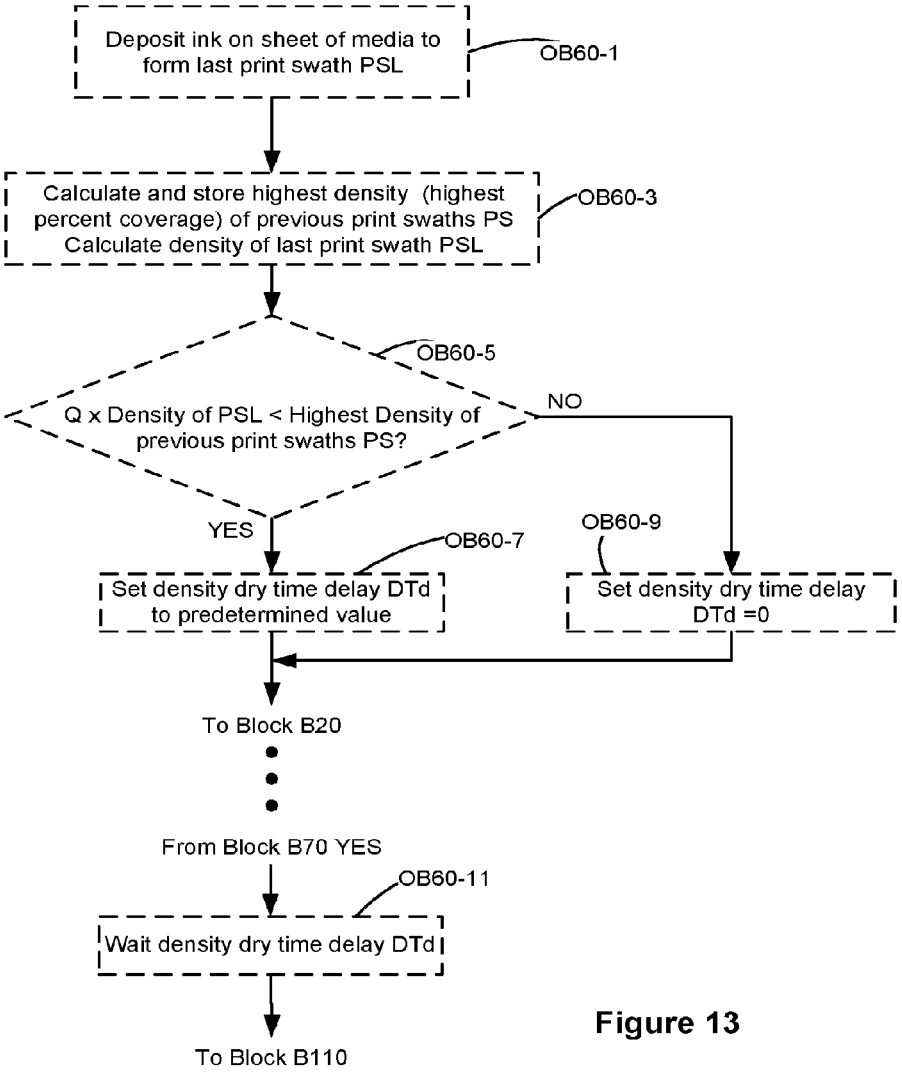
FIG. 13 is a flowchart of a modification to the method of FIGS. 9A-9B illustrating modifying the scan interval based on a comparison of the density of the last print swath to be printed to the highest density of the previous print swaths.

FIG. 13 illustrates a way of modifying method M10 to adjust the drying times where the print density of a prior print swath is greater than that of the last print swath PSL. The controller 500 has density information available for each print swath PS as it also controls the firing of printheads which deposit the ink onto the surface of the sheet of media 50. Block B10 is replaced by optional block OB60-1 to deposit ink on a sheet of media to form a last print swath PSL that will be printed on that side of the sheet of media. At optional block OB60-3, controller 500 calculates and stores the highest density of the previous print swaths PS and also calculates the density of the last print swath PSL. As one of ordinary skill in the art would recognize, controller 500 may calculate the density of each print swath and may store the value in look up table 503 for use in determining the highest density of the previous print swaths. Prior to printing the last print swath PSL, controller 500 may also keep a running comparison of the density of prior print swath with the density with the next print swath and retain only the highest density of the prior print swaths in look up table 503. If the density of the next print swath was greater, controller 500 would overwrite the previous value in look up table 503. If not, the density of the next print swath would be discarded and the prior value would be retained in look up table 503.

At optional block OB60-5 a determination is made to see if the density of the last print swath PSL on that side of the sheet of media being printed is a predetermined amount less than the highest density value that is in look up table 503. Typically, in the printed image, a previously printed print swath will be denser or darker than the last print swath PSL on that side of the sheet of media and may require more drying time than the last print swath PSL. If the last print swath PSL dried more rapidly than a previous print swath and the sheet of media were moved based on the gloss sensor response for the last print swath PSL, the previous higher density print swath may not be dry and moving the sheet of media may result in a print defect such as a smear. For example, the last print swath density may be five to ten percent of the highest density of the previous print swaths and typically would dry rapidly.

In one form, the density of the last print swath PSL may be multiplied by a factor Q when making the determination to see if additional drying time is needed. The factor Q would be greater than 1 and may be within a range up to 20, meaning that the density of the last print swath PSL ranges between being about the same as the highest density of the prior print swaths to being about five percent of the highest density of the prior print swaths. IfYES, the factored density of the last print swath is less than the previous highest density, method M10 proceeds to optional block OB60-7 where a density dry time delay DTd is set to a predetermined value sufficient to allow the higher density previous print swath to dry. The density time dry time delay that is used may be stored in memory, may be an empirically determined fixed value, may be a value selected from a range of values that correspond to density ranges, or, may be a maximum/minimum density dry time delay that may be scaled down/up based on the density of the last print swath PSL. Thereafter method M10 proceeds back to block B20. If NO, the factored density of the last print swath PSL is not less than the previous highest density by factor Q, then method M10 proceeds to optional block OB60-9 where a density dry time delay is set to zero indicating that additional drying time is not required. Method M10 then proceeds back to block B20 and continues as previously described. After a determination is made at block B70 that gloss values Gp and Gn are within a predetermined range, at optional block OB60-11, method M10 waits for density dry time delay DTd to expire. Method M10 then proceeds to block B90.

Another modification to method M10 is the introduction of a pause before the first scan by the gloss sensor is made as in shown in optional block OB70-1 (see FIG. 9A) shown prior to block B20. The reason for this is that when ink is laid down on the surface of a sheet of media 50, there is a quick transient response that may need to settle before gloss measurements begin. This transient response is due to the initial wetting of the surface before absorption begins as well as the media flexing due to the weight of the ink applied. This transient response has been observed in testing, and this initial pause, if used, would be very small (approximately 2 seconds).

Figure 14:
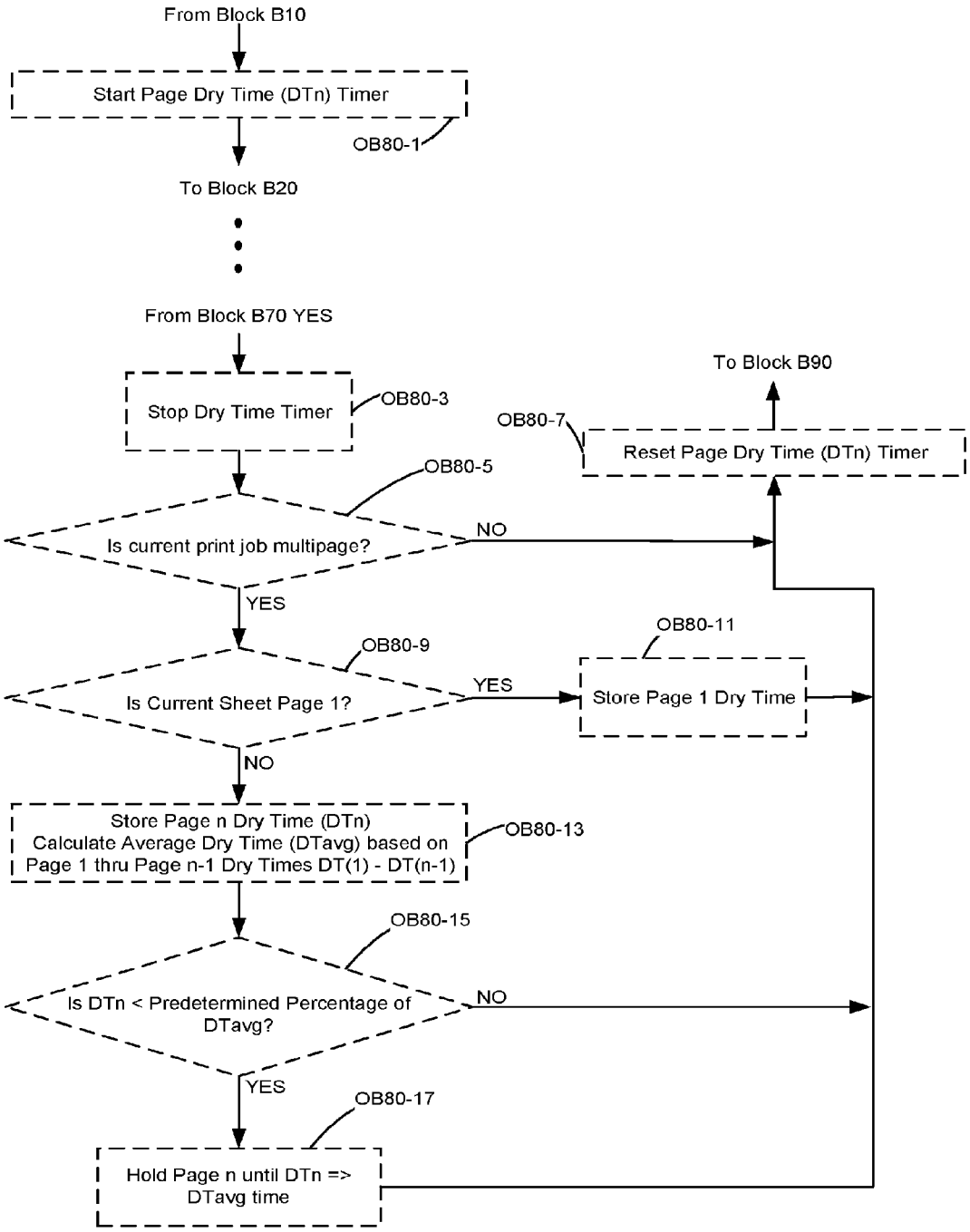
FIG. 14 is a flowchart of a modification to the method of FIGS. 9A-9B illustrating adjusting the drying time of a sheet in a multipage print job based on a comparison of the drying time for that sheet with an average of the drying times of the prior sheets in the multipage print job.

For a multipage printout, the measured dry times for the previous sheets may be taken into account to be more robust against fluke gloss measurements. For example, if the measured dry time of the previous sheets of media of the current printout were typically 8 seconds, a measured dry time of 4 seconds on a subsequent sheet of media may appear suspicious. It is also possible that the user has encountered a transition between two different types of media in the media tray, but to be safe in such a scenario it may be best to implement a longer dry time. One example modification to method M10 for a multipage print job is illustrated in FIG. 14.

After block B10, at optional block OB80-1, a Page Dry Time Timer is started and method M10 proceeds to Block B20. Method M10 continues as previously set out to block B70. If a YES determination has been made at block B70, the current sheet of media is sufficiently dry, and method M10 proceeds to optional block OB80-3 to stop the Dry Time Timer. At optional block OB80-5, it is determined if the current print job is a multipage print job. If NO, method M10 proceeds to optional block OB80-7 where the Dry Time Timer is reset and method M10 returns then to block B90. If YES, method M10 proceeds to optional block OB80-9 to determine if the current sheet of media undergoing printing is the first page in the multi-page print job.

At optional block OB80-9, if YES, the current sheet of media is page one, method M10 goes to optional block OB80-11 where the Dry Time for the first page is stored. From optional block OB80-11, method M10 returns to optional block OB80-7 and then back to block B90 and to the next sheet of media to be printed. If NO, the current sheet is a sheet subsequent to the first page, generally designated Page n where Page 1 is the first page, method M10 goes to optional block OB80-13 where the Page n Dry Time (DTn) is stored and an Average Dry Time DTavg is calculated based on the Page 1 through Page n−1 dry times DT(1)-DT(n−1) that have been stored for each page of the multi-page print job.

Next at optional block OB80-15 a determination is made to see if dry time DTn for Page n is less than a predetermined percentage of the average dry times DTavg. If NO, method M10 proceeds back to optional block OB80-7. If YES, it is determined that the current dry time DTn is less than a predetermined percentage of the average of the stored dry times DTavg of the previous sheets of media in the current print job (for example 70%), then at optional block OB80-17, the current sheet of media, Page n, will be held until the dry time is about equal to or slightly greater than the average measured dry time, DTavg. Thereafter, method M10 returns to optional block OB80-7.

Figure 15:
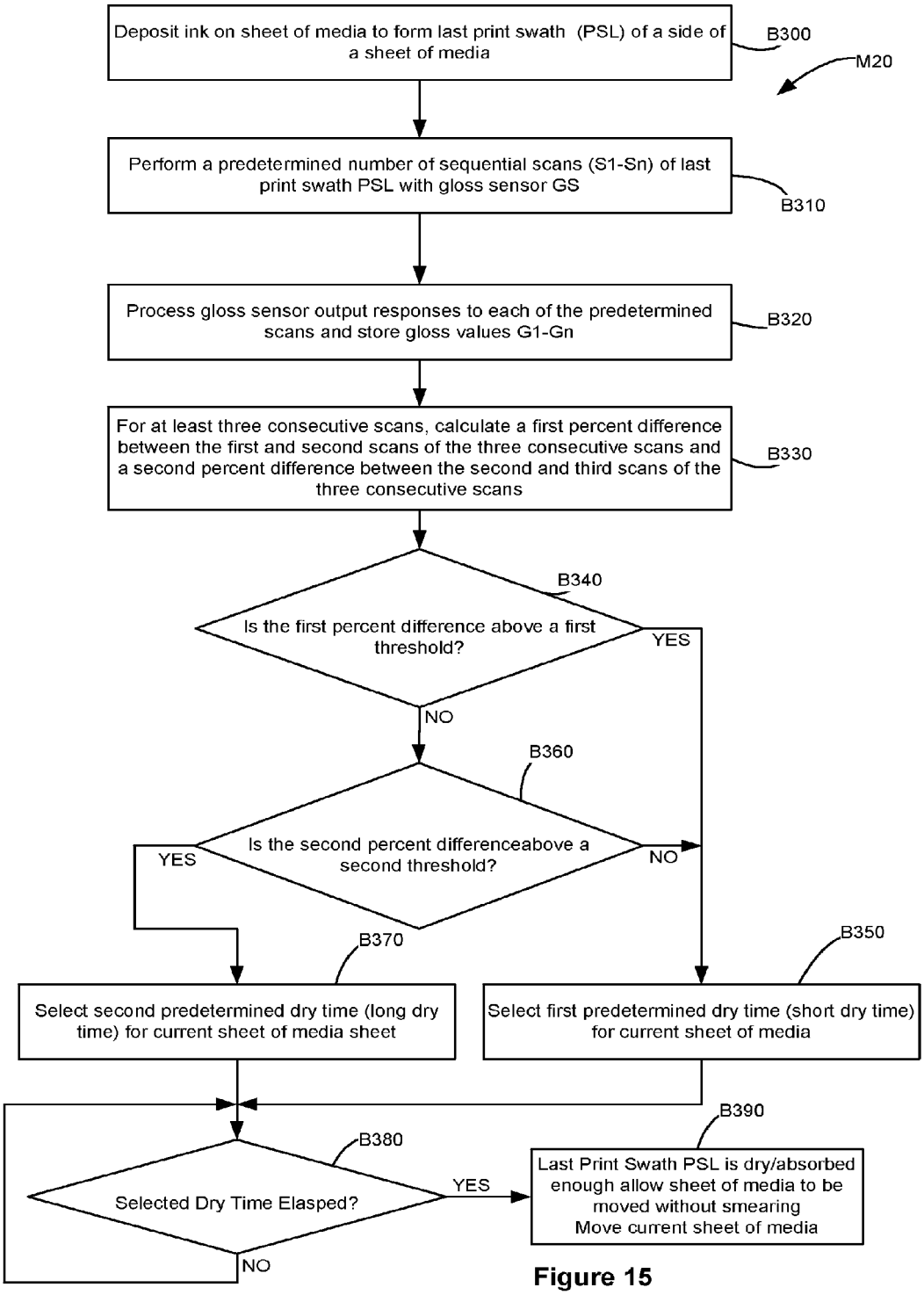
FIG. 15 is a flowchart for a method for determining drying time based on the rate of change in the gloss sensor response.

Another embodiment of a dry time determination method is shown in FIG. 15. Method M10 is a "monitoring algorithm," continually making measurements until a certain condition is met (for example, a difference between measurements less than a predetermined amount or loop count limit is reached). An alternate approach is to have a threshold method, method M20, where a small number of measurements are made at the beginning and then determine a dry time to wait. Referring back to FIGS. 7 and 8, note that the faster drying media M2 had a higher initial slope than the slower drying media M1. By looking at the magnitude of these initial slopes, it can be determined if a "slow drying" or a "fast drying" media paper is in use.

For method M20, at block B300, the last print swath PSL is deposited on a side of a sheet of media 50. At block B310, a predetermined number of sequential scans S1-Sn are done by gloss sensor GS on the last print swath PSL. For example, three measurements G1-G3 may be made back to back to back unidirectionally with no delay added between scans. Additional sequential scans may be made. At block B320, the output responses of gloss sensor GS to each of the predetermined scans S1-Sn is processed and the gloss values G1-Gn for scans S1-Sn are stored. At block B330, for at least three consecutive scans, a first percent difference between the corresponding gloss values of the first and second scans of the three consecutive scans is calculated and a second percent difference between the corresponding gloss values of the second and third scans of the three consecutive scans is calculated. For the example three scans, two percent difference values are calculated. The differences between gloss value G1 of Scan 1 and gloss value G2 of Scan 2 and between gloss value G2 of Scan 2 and gloss value G3 of Scan 3 are determined. At block B340, a determination is made to see if the first percent difference is above a first threshold (high) as it indicates that a fast absorbing paper is in use. If YES, method M20 proceeds to block B350 where a first predetermined dry time (short dry time) is selected for the current media sheet. If NO at block B340, the first percent difference is below that first threshold (low) and method M20 proceeds to block B360. If the first percent difference is low, it does not necessarily mean that the media is slow absorbing. The reason is that it is possible that the media is so fast absorbing that the ink was already mostly absorbed before the first scan, and thus there is little difference between the first and second scans. To resolve this, the second percent difference (between scans two and three) is considered at block B360. If NO the second percent difference is not above a second threshold, it is a fast absorbing paper since it is already near or at its final steady state and method M20 proceeds to block B350. However, if YES, the second percent difference is above the second threshold, it is a slow absorbing media since the output of gloss sensor GS has not reached a range about its final steady state value and method M20 proceeds to block B370 where a second predetermined dry time (long dry time) that is greater than the first predetermined dry time is selected for the current media sheet.

The long dry time and short dry time are predetermined values. These may be default values or, if media sensor 150 is available, then the media type may be determined and the long and short dry times corresponding to the determined media type may be found in lookup table 503.

The selected first and second thresholds are dependent on the base ink density used. The term "base ink density" refers to the amount or volume of ink applied per unit area of the sheet of media. From testing, for 100% base ink density, the first threshold is about a 16% difference and the second is about a 1% difference. For 70% base ink density the first and second thresholds would be about an 11% difference and about a 2.3% difference, respectively.

From blocks B350 and B370, method M20 proceeds to block B380. At block B380 a determination is made if the selected dry time has elapsed. If NO, method M20 waits until the selected dry time has elapsed. If YES, the dry time has elapsed, method M20 goes to block B390 where the last print swath PSL is dry enough for the sheet of media to be moved without smearing and the sheet of media can be moved for further processing.

As previously described optional block OB20-1 may be inserted prior to block B300 to determine a type of media for the sheet of media that is being printed. The short and long dry times in blocks B350 and B370 can then be selected by the controller 500 from look up table 503 where they are stored for each media type. Default short and long dry times would be used if the type of media could not be determined. Also, optional block OB70-1 may be used prior to block B310 to delay the sequential scans for a predetermined period for the reasons previously described. Further, the method for determining the optimum position for the scan within the last print swath PSL shown in FIG. 12 may be inserted prior to block 310.

An advantage of method M20 is that a dry time determination can be made in a short amount of time. The scan by gloss sensor GS starts right after the last drop of ink is fired for the last print swath PSL on the side of the sheet of media that is being printed. For example, for A4 or Letter media sheets, if three 20 ips (inches per second) printhead carrier moves are made for the three gloss sensor scans, with 60 ips printhead carrier return moves between them, the total time for these measurements is about 2.1 seconds, well under a typical dry time. Thus method M20 could be used to catch slow-drying papers, where a default short aggressive dry time would be used unless these measurements determine that the paper is slow drying, thus avoiding smearing problems.

The methods M10, M20 including all the optional aspects, may be performed, for example, in inkjet printer 12 by program instructions executed by controller 500 or in the computer 200 or in a combination of the controller 500 and computer 200. Once the methods are started, the methods may be completed by controller 500 automatically without user intervention. It has also been observed in testing that different gloss sensor scan directions can give slightly different readings. This is mostly due to slight printhead carrier cocking when moving in different directions. Thus, to get more consistent readings with less noise, all scans may be done in the same direction, with a printhead carrier return occurring between each scan during the pause between scans.

The methods disclosed herein may be used with duplex printing and also be used for simplex printing to avoid leading edge "snowplow" smear where the leading edge of following sheet of media scrapes the surface of the sheet of media ahead of it as well as sheet-to-sheet offset smear in the exit tray. In such an application, a region of the last print swath is repeatedly measured as before. Once a determined dry time has elapsed, that sheet is ejected and the next sheet is printed with the method repeating for every sheet of media.

The methods above may be performed, for example, each time a new media type is used in inkjet printer 12, or when a media type used in inkjet printer 12 is changed.

Those skilled in the art will recognize that the determinations made in accordance with the present methods may vary from those set forth in the example above, depending on a variety of factors, including the mechanical and control configurations of the inkjet printer. Further, the foregoing description of several methods and embodiments of the invention have been presented for purposes of illustration. It is not intended to be exhaustive or to limit the invention to the precise steps and/or forms disclosed, and obviously many modifications and variations are possible in light of the above teaching. It is intended that the scope of the invention be defined by the claims appended hereto.

What is claimed is:

1. A method for controlling operation of a printer, comprising:

advancing a sheet of print media in a media feed direction to a first position;

depositing, by a printhead, a print swath along a scan direction on the sheet of print media;

determining a gloss value of the print swath based on a detected amount of specular reflection from the ink swath;

determining if the sheet of print media is moveable without smearing based on the determined gloss value;

upon the condition that the sheet of print media is determined to be moveable without smearing, advancing the sheet of print media in the media feed direction to a second position; and upon the condition that the sheet of print media is determined to be not moveable without smearing, maintaining the sheet of print media in the first position.

2. The method of claim 1, wherein the step of determining a gloss value comprises scanning a gloss sensor across the print swath.

3. The method of claim 2, further comprising the steps of:

determining an optimum position within the print swath along a subscan direction orthogonal to the scan direction based on a highest print density within the print swath; and positioning the gloss sensor at the optimum position prior to scanning.

4. The method of claim 1, wherein the step of determining a gloss value of the print swath comprises determining multiple gloss values, with a set time interval between each determination of the gloss value.

5. The method of claim 4, wherein the step of determining if the sheet of print media is moveable without smearing comprises determining if the gloss value has reached a steady state condition.

6. The method of claim 4, wherein the step of determining if the sheet of print media is moveable without smearing comprises determining if the change between gloss values from one time interval to a next time interval is below a predetermined threshold.

7. The method of claim 4, further comprising the step of limiting the number of determinations of gloss value for the print swath to a maximum number.

8. The method of claim 4, further comprising the steps of:

determining a type of the print media; and selecting a length of the set time interval based on the determined type of print media.

9. The method of claim 1, further comprising delaying the step of advancing the sheet of print media a set amount of time based on percent coverage of the print swath.

10. The method of claim 1, further comprising:

determining if a density value of a last print swath on the sheet of print media is less than a density value of any previous print swath on the sheet of print media;

upon the condition that the density value of the last print swath is less than a density value of any previous print swath, delaying the step of advancing the sheet of print media for a predetermined time period; and upon the condition that the density value of the last print swath is not less than a density value of any previous print swath, not delaying the step of advancing the sheet of print media.

* * * * *